US008850987B2

(12) United States Patent
Lévesque et al.

(10) Patent No.: US 8,850,987 B2
(45) Date of Patent: Oct. 7, 2014

(54) METHOD AND SYSTEM FOR EXPANDABLE MODULAR RAFT AND A WATER RIDE USING THE SAME

(75) Inventors: Guy Lévesque, Vancouver (CA); Tat K. Won, Vancouver (CA); Peter Petkov, Port Coquitlam (CA); Raymond J. Dubois, Coquitlam (CA)

(73) Assignee: Whitewater West Industries Ltd. (CA)

( * ) Notice: Subject to any disclaimer, the term of this patent is extended or adjusted under 35 U.S.C. 154(b) by 190 days.

(21) Appl. No.: 13/187,350

(22) Filed: Jul. 20, 2011

(65) Prior Publication Data

US 2012/0017796 A1 Jan. 26, 2012

Related U.S. Application Data

(60) Provisional application No. 61/366,486, filed on Jul. 21, 2010.

(51) Int. Cl.

| | |
|---|---|
| ***A63G 1/00*** | (2006.01) |
| ***B63B 35/76*** | (2006.01) |
| ***A63G 21/18*** | (2006.01) |
| ***A63H 33/08*** | (2006.01) |
| *B63B 17/00* | (2006.01) |

(52) U.S. Cl.

CPC ..... *B63B 35/76* (2013.01); *B63B 2017/0054* (2013.01); *A63G 21/18* (2013.01); *B63H 7/085* (2013.01); *A63H 33/086* (2013.01); *B63H 17/00* (2013.01)

USPC ..... 104/72; 104/73; 446/121; 446/81

(58) Field of Classification Search

CPC ..... A63G 21/18; A63H 33/086; B63B 17/00; B63B 35/76; B63B 7/055; B63B 2017/0054; B63B 7/04; B63B 35/73; B63B 3/08; B63B 35/38; B63B 35/34

USPC ..... 104/69, 70, 71, 72, 73

See application file for complete search history.

(56) References Cited

U.S. PATENT DOCUMENTS

| | | | | | |
|---|---|---|---|---|---|
| 2,377,803 | A | * | 6/1945 | Morner | 114/367 |
| 3,822,499 | A | * | 7/1974 | De Vos | 446/121 |
| 4,655,156 | A | * | 4/1987 | Svirklys et al. | 114/266 |
| 4,768,456 | A | * | 9/1988 | Jones et al. | 114/266 |
| 5,251,560 | A | * | 10/1993 | Ban et al. | 114/266 |
| 5,643,031 | A | * | 7/1997 | Fenton et al. | 441/130 |
| 5,682,833 | A | * | 11/1997 | Eva et al. | 114/263 |
| 5,690,523 | A | * | 11/1997 | Yu | 441/35 |
| 5,772,484 | A | * | 6/1998 | Sikorski | 441/81 |
| 5,779,509 | A | * | 7/1998 | Barman | 441/65 |

(Continued)

*Primary Examiner* — Jason C Smith

(74) *Attorney, Agent, or Firm* — Greenberg Traurig

(57) ABSTRACT

The present invention is related to a method and system for expandable modular raft and a water ride using the same. In one embodiment, the expandable modular raft can include a raft, and a base unit attached to the raft and configured to receive a building block. The building block can be configured to be force fit to the base unit and/or each other. Furthermore, the building block could be formed from various shapes. The expandable modular raft can be used in a water ride and can float along a path such as a river. Interactive units such as water guns can be placed along the path to allow observers to interact with the riders. Furthermore, a raft area can be located adjacent the path to store the rafts, while a building block area can be located adjacent the path to store the building blocks.

26 Claims, 27 Drawing Sheets

(56) References Cited

U.S. PATENT DOCUMENTS

| | | | | |
|---|---|---|---|---|
| 5,967,869 | A * | 10/1999 | Wiggins | 441/38 |
| 6,033,151 | A * | 3/2000 | Tsou | 405/219 |
| 6,685,520 | B1 * | 2/2004 | Wiggins | 441/40 |
| 7,213,531 | B2 * | 5/2007 | Ahern | 114/263 |
| 7,587,986 | B2 * | 9/2009 | Neidert et al. | 114/61.15 |
| 8,037,837 | B2 * | 10/2011 | La Violette et al. | 114/263 |
| 8,136,453 | B2 * | 3/2012 | Hunter et al. | 104/60 |
| 8,375,864 | B1 * | 2/2013 | Crawford et al. | 104/73 |
| 2004/0208707 | A1 * | 10/2004 | Huang et al. | 405/206 |
| 2012/0017796 | A1 * | 1/2012 | Levesque et al. | 104/72 |
| 2013/0025491 | A1 * | 1/2013 | Crawford et al. | 104/28 |

* cited by examiner

| PLATE DIMENSIONS | | |
|---|---|---|
| PLATE (ixj STUDS) | DIM A | DIM B |
| 4x4 | 14.9000 | 14.9000 |
| 4x6 | 14.9000 | 22.3500 |
| 4x8 | 14.9000 | 29.8000 |
| 5x5 | 18.6250 | 18.6250 |
| 5x6 | 18.6250 | 22.3500 |
| 5x8 | 18.6250 | 29.8000 |

FIG. 55

METHOD AND SYSTEM FOR EXPANDABLE MODULAR RAFT AND A WATER RIDE USING THE SAME

CROSS REFERENCE TO RELATED APPLICATIONS

This application claims the benefit of U.S. Provisional Patent Application Ser. No. 61/366,486, filed on Jul. 21, 2010, entitled "METHOD AND SYSTEM FOR EXPANDABLE MODULAR RAFT AND A WATER RIDE USING THE SAME," which is hereby incorporated by reference in its entirety.

BACKGROUND

1. Field of the Invention

The present invention relates to a method and system for expandable modular raft and a water ride using the same.

2. Description of the Related Art

A conventional water ride can include a raft which can traverse a path or a river. In most instances these water rides are called "lazy rivers." The so-called lazy rivers promote a gentle atmosphere of relaxation as riders traverse the river. However, the rafts are often pre-assembled and of a single shape or of limited designs. Thus, the rider has to pick a raft which has already been pre-assembled for him and cannot customize the raft. However, as riders are demanding more interactivity, such pre-assembled rafts may not provide the level of entertainment expected by the riders.

Thus, there is a need for a method and system for expandable modular raft and a water ride using the same.

SUMMARY

The present invention is related to a method and system for expandable modular raft and a water ride using the same. In one embodiment, the expandable modular raft can include a raft, and a base unit attached to the raft and configured to receive a building block. The building block can be configured to be force fit to the base unit and/or each other. Furthermore, the building block could be formed from various shapes. Thus, a rider can customize the expandable modular raft to his liking, allowing for an interactive experience which the rider appreciates. In addition, the expandable modular raft can be used in a water ride and can float along a path such as a river. Interactive units such as water guns can be placed along the path to allow observers to interact with the riders.

Furthermore, a raft area can be located adjacent the path to store the rafts, while a building block area can be located adjacent the path to store the building blocks. To build or form an expandable modular raft, a rider would grab a raft and one or more building blocks from their respective areas. The rider can then enter the path. Upon exiting, the rider or a staff member can disassemble the expandable modular raft into their respective areas. This allows for easy access to all of the components of the expandable modular raft and allows for more riders to access the path with the expandable modular raft.

In one embodiment, the present invention is an expandable modular raft system including a raft, and a base unit attached to the raft and configured to receive a building block.

In another embodiment, the present invention is an expandable modular raft system including a raft including an inner tube, a base unit attached to the raft, and a plurality of building blocks configured to be force fit with the base unit and each other, wherein the building blocks are configured to float in water, compress under a compressive load, and retain its shape upon removal of the compressive load.

In yet another embodiment, the present invention is a water ride including a path, a raft area adjacent the path storing a plurality of rafts, and a building block area adjacent the path storing a plurality of building blocks, wherein the rafts and the building blocks are configured to be combined to form an expandable modular raft system which can traverse the path.

BRIEF DESCRIPTION OF THE DRAWINGS

The features, objects, and advantages of the present invention will become more apparent from the detailed description set forth below when taken in conjunction with the drawings, wherein:

FIG. 50 depicts a side view of a base unit according to an embodiment of the present invention;

FIG. 55 depicts a chart including dimensions of a base unit according to an embodiment of the present invention;

DETAILED DESCRIPTION

The detailed description of exemplary embodiments herein makes reference to the accompanying drawings and pictures, which show the exemplary embodiment by way of illustration and its best mode. While these exemplary embodiments are described in sufficient detail to enable those skilled in the art to practice the invention, it should be understood that other embodiments may be realized and that logical and mechanical changes may be made without departing from the spirit and scope of the invention. Thus, the detailed description herein is presented for purposes of illustration only and not of limitation. For example, the steps recited in any of the method or process descriptions may be executed in any order and are not limited to the order presented. Moreover, any of the functions or steps may be outsourced to or performed by one or more third parties. Furthermore, any reference to singular includes plural embodiments, and any reference to more than one component may include a singular embodiment.

Figure 78:
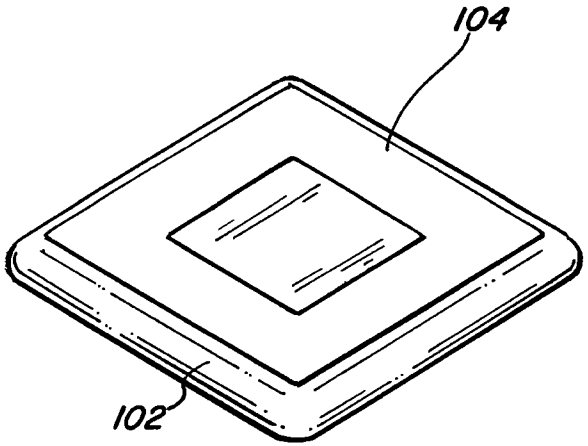
FIGS. 77 and 78 depict a base unit on a raft according to an embodiment of the present invention.
Figure 77:
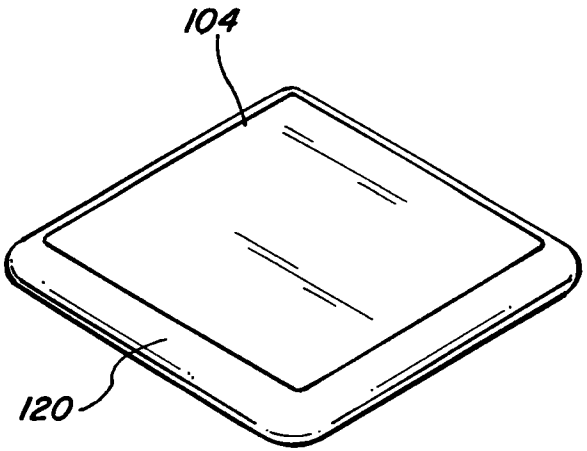

In one embodiment, the present invention includes an expandable modular raft system 100 as shown in FIGS. 1 to 17, 77 and 78. As can be seen, the expandable modular raft system 100 can include, for example, a raft 102, a base unit 104, and/or building blocks 108. A user 106 can rest on the raft 102 and be supported by the raft 102. The raft 102 can be, for example, an inner tube formed from rubber, polyurethane, plastic, vinyl, foam or any other type of material which can float in water either with or without being filled with fluid or air. In one embodiment, the raft 102 can be a boat or a log raft. The raft 102 can also include, for example, various theme shapes such as pirates, knights, animals, or other shapes which may entertain or be visually pleasing. The raft 102 can also be opaque, semi-opaque, translucent, semi-translucent, or any combination thereof. In one embodiment, the raft 102 is formed from a round 48 inch single or double inner tubes. The raft 102 can be, for example, standard circular tubes and/or rectangular tubes. However, the raft 102 can be of any shape, including shapes of animals or other objects. The raft 102 can also be a flat mattress as shown in FIGS. 77 and 78. The building blocks 108 can be attached, for example, to the base unit 104. In one embodiment, the raft 102 can hold one or more persons.

The base unit 104 can be formed, for example, from rigid and/or semi-rigid material. In one embodiment, the base unit 104 is formed, for example, from PVC. In one embodiment, the base unit 104 is semi-permanently attached to the raft 102 such that it is not easily removed by a human without the aid of tools. In another embodiment, the base unit 104 is attached to the raft 102 using clips and/or other male/female mating systems. In yet another embodiment, the base unit 104 can be attached to the raft 102 through, for example, a glue, welding, or any other type of adherent. In another embodiment, the base unit 104 can be attached to the raft 102 using, for example, mechanical locks, fasteners, and/or hook and loop fasteners. In one embodiment, a rider 106 can sit, stand, or rest on the raft 102 and float in water.

As seen in FIGS. 4-8, the expandable modular raft system can include, for example, one or more building blocks 108 which can be attached to the base unit 104 and or each other. As can be seen, the building blocks 108 can be formed in a variety of sizes, shapes, and/or colors. In addition the building blocks 108 can have a variety of indicia on them such as images, logos, pictures, or other types of graphics. In one embodiment, the building blocks can be, for example, a brick, a semi-spherical object, a spherical object, a curved roof, a propeller, a shape of an animal, or any other types of object which can be attached to the base unit 104.

The building blocks 108 can be formed, for example, for a foam material. In one embodiment, the building blocks 108 can be formed from Ethylene Vinyl Acetate (EVA) foam, a polymer. The building blocks 108 can also be formed, for example, from other polymers. Furthermore, the building blocks 108 can also be, for example, formed from any type of material that can float in water. However, the building blocks 108 need not float in water. In one embodiment, the building blocks 108 can be LEGO® bricks with scale factor of 11.75 relative to standard LEGO® sizing. In another embodiment, the building blocks 108 can be formed and designed to be resistant to failure in shear, tension, compression and abrasion from activities that can be expected in a water park environment such as trampling, throwing, pulling, dragging, etc.

In yet another embodiment, the building blocks 108 can be coated or manufactured to be resistant to chlorine damage (both structurally and aesthetically), and/or resistant to shear. By being resistant to shearing, the building blocks can have an extended life since a small tear in a building block 108 could easily propagate through the building block 108 proper. As the building blocks 108 will ideally mate by means of a force fit, a propagated tear in the wall of the building blocks 108 could compromise assembly strength and deem the building blocks 108 useless. However, as noted below, the building blocks 108 need not be connected to each other using a force fit, but can also be connected to each other using other methods. In addition, the building blocks 108 can also coated or manufactured to be resistant to ultraviolet (UV) radiation. This can reduce the rate of degradation to within reasonable limits on replacement time.

The building blocks 108 can be formed, for example, from the following parameters:

- Compression: (1) Shape retention over repeated compression cycles; (2) Shape retention upon the removal of a prolonged compressive load
- Tension: (1) Shape retention over repeated tensions cycles; (2) Shape retention upon the removal of a prolonged tensile load
- Shear: (1) The material shall resist shearing under an applied shearing force (direct and torsional) deliverable by that of an average middle aged child
- Abrasion: (1) The material surface should not rapidly degrade under everyday handling conditions consistent with that of a water park
- Chlorine Saturation: (1) The material shall retain its color pigmentation and geometric stability when saturated in chlorinated water of concentration levels typical of a public pool for a time period of 8 hours a day (or longer) over the course of the summer months
- UV Degradation: (1) The material shall retain its color pigmentation and geometric stability under exposure to solar radiation typical of the region of California for a period of 8 hours per day over the course of the summer months.

In addition, to allow for force fitting of the building blocks 108 to each other and/or the base unit 104, the production of the building blocks 108 and/or the base unit 104 can have a tolerance, for example, of ±2 mm. In one embodiment, the building blocks 108 can achieve force fit by utilizing magnets and studs. For example, the magnets can be incorporated into studs and bottom surface of the building blocks 108. In another embodiment, the building blocks 108 can be connected to each other and/or the base unit 104 using mechanical locks, fasteners, and/or hook and loop fasteners. In yet another embodiment, the building blocks 108 could also be attached to each other and/or the base unit 104 using clips and/or other male/female mating systems.

Figure 80:
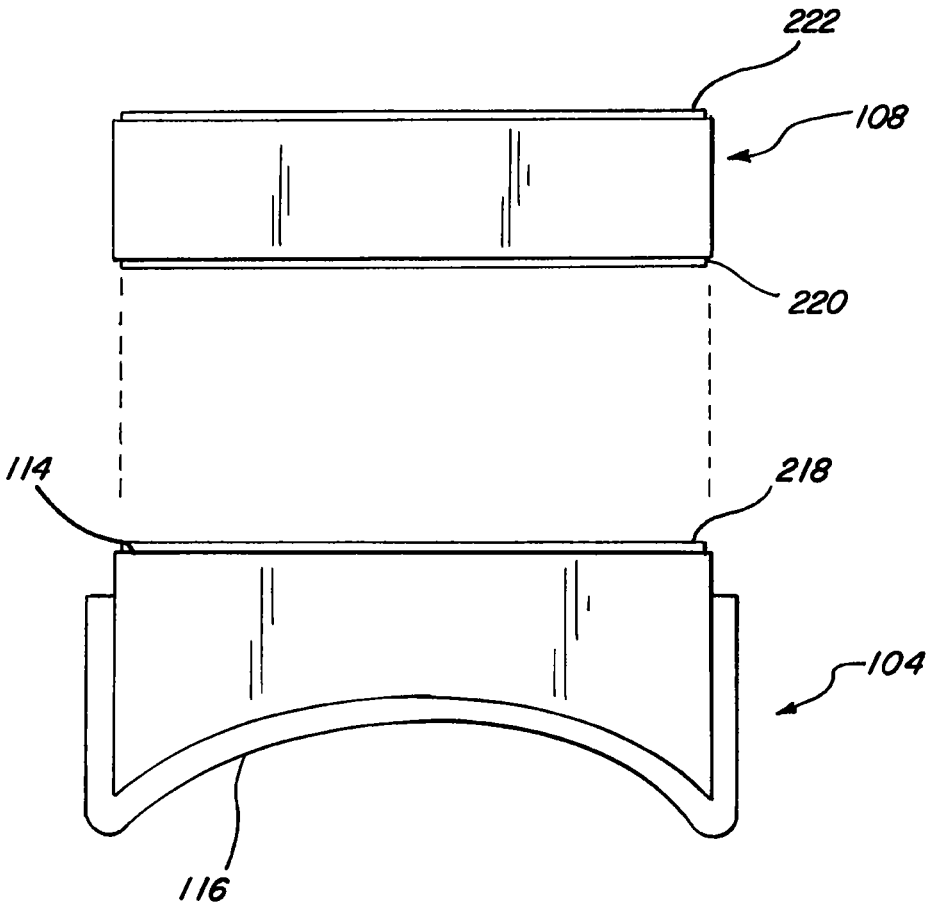
FIG. 80 depicts a base unit and a building block according to an embodiment of the present invention.

For example, as seen in FIG. 80, the base unit 104 can include a first connection unit 218, while the building block 108 can include a second connection unit 220, and a third connection unit 222. The first connection unit 218 and the second connection unit 220 can mate with each other. For example, the first connection unit 218 can be formed from loops, while the second connection unit 220 can be formed from hooks, or vice versa. The connection unit 222 can also be on top of the building block 108 to allow the blocks 108 to be connected to each other.

As seen in FIGS. 9 to 17, the raft 102 can support not just a single rider 106, but multiple riders. Thus, the raft 102 can be shaped such that it defines multiple holes instead of just one to support multiple riders or a single rider. In addition, the raft 102 could also have a single large hole instead of multiple holes to support the multiple riders or the single rider. In one embodiment, the raft 102 need not have holes in it. Furthermore, multiple rafts 102 of various sizes can be connected together.

Figure 2:
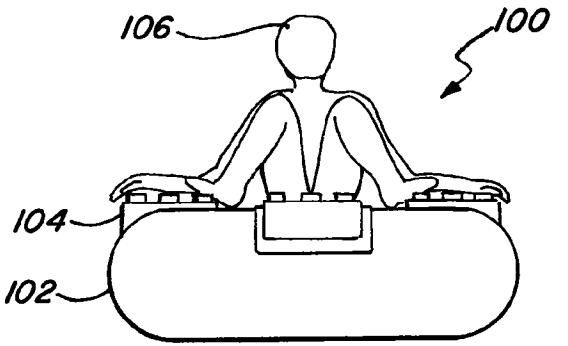
FIGS. 1 to 17 are perspective views of a expandable modular raft system according to an embodiment of the present invention.
Figure 3B:
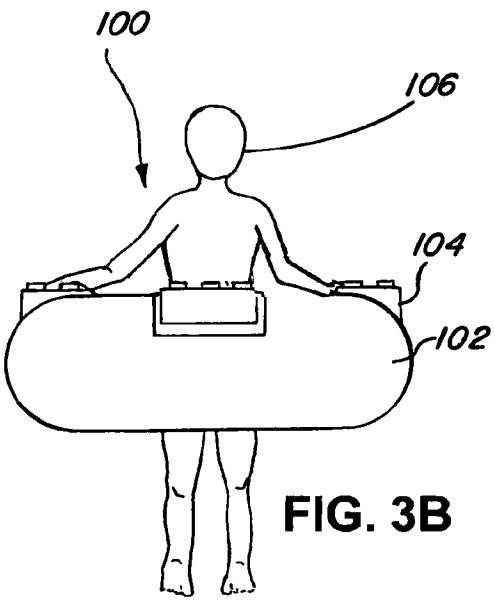
Figure 3A:
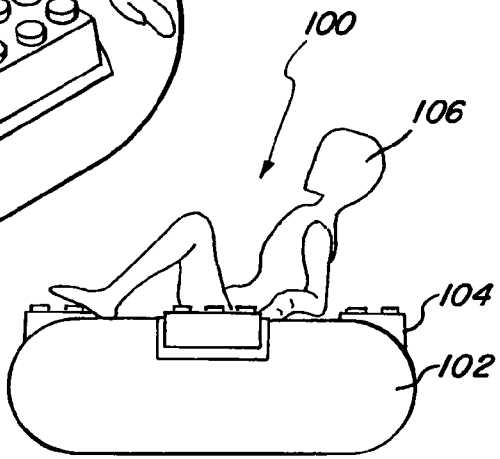
Figure 1:
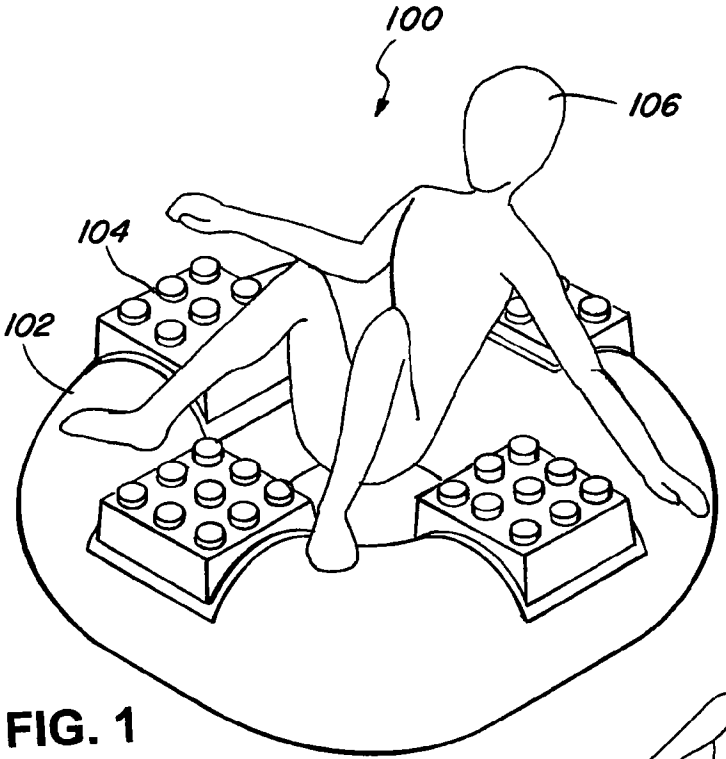
Figure 5:
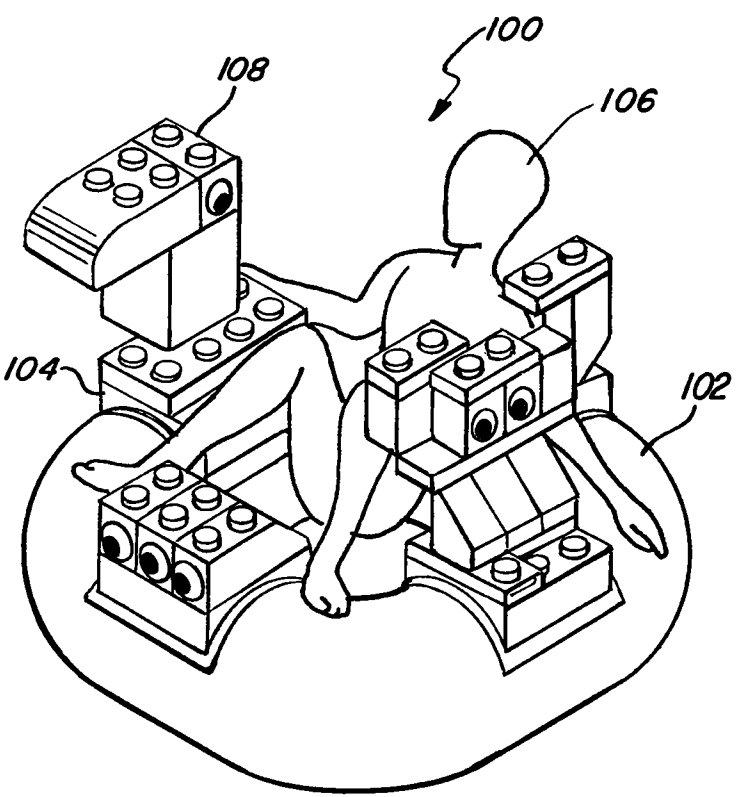
Figure 4:
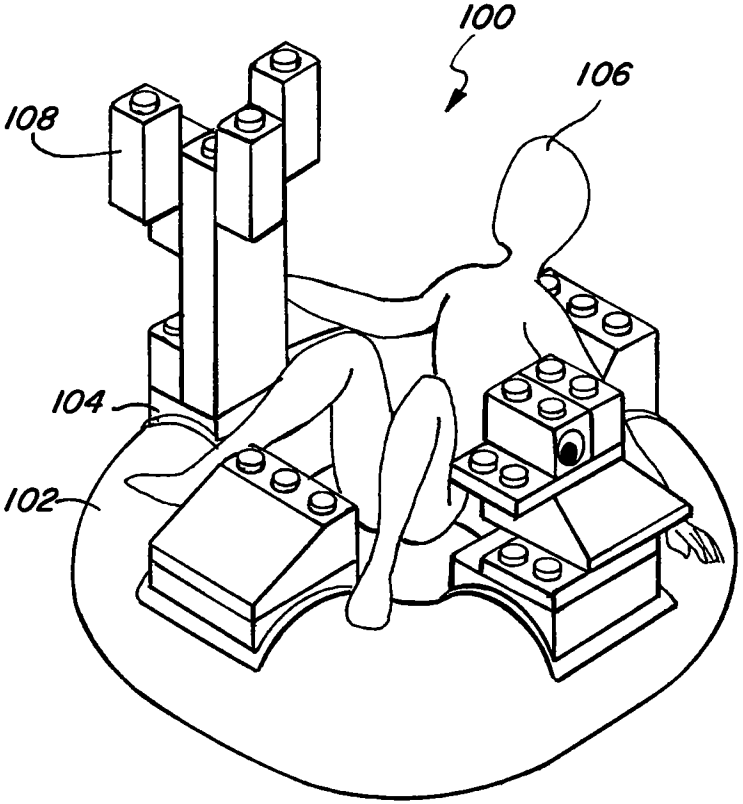
Figure 7:
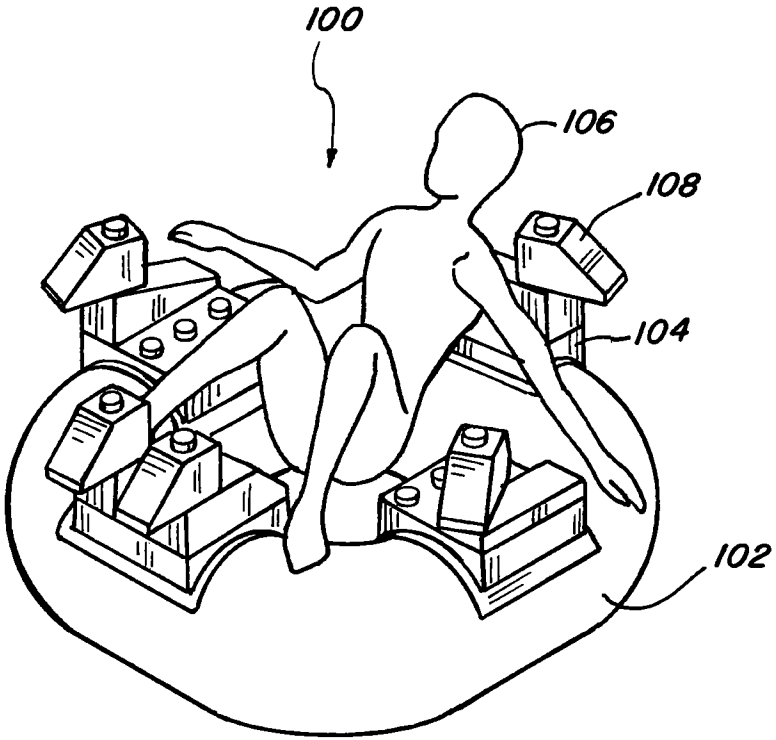
Figure 6:
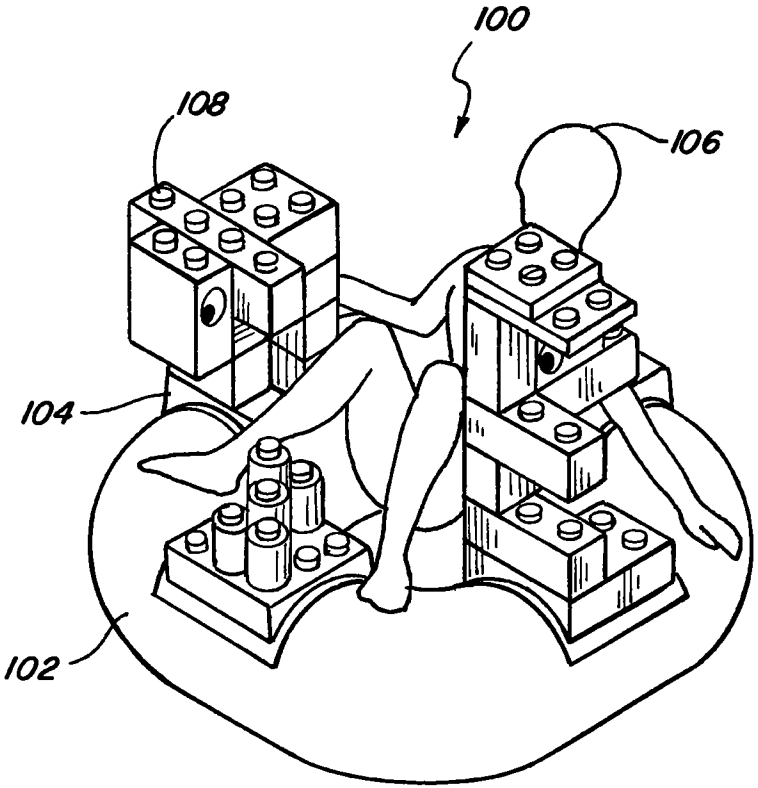
Figure 8:
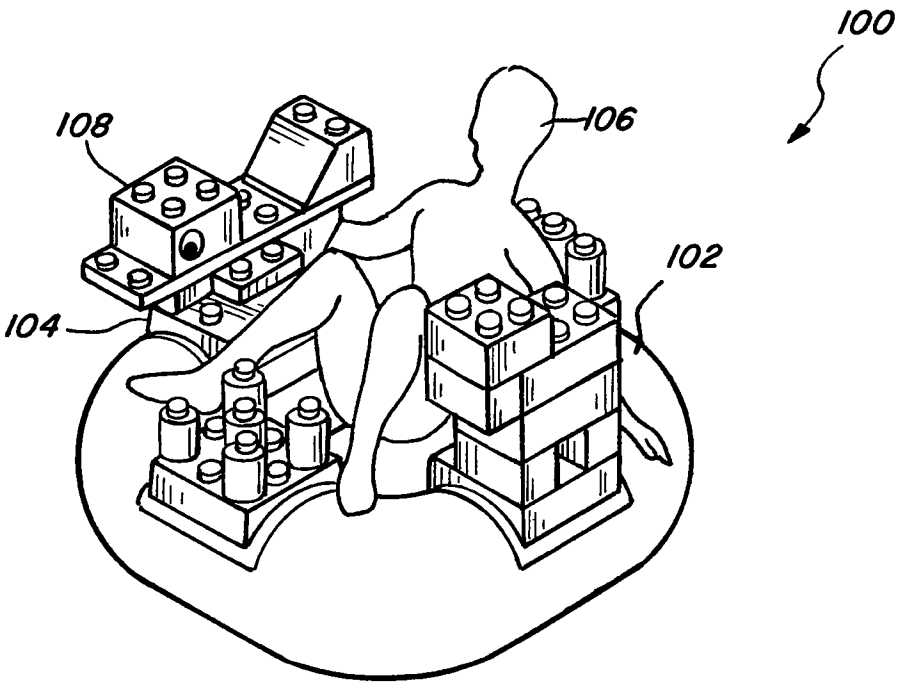
Figure 10:
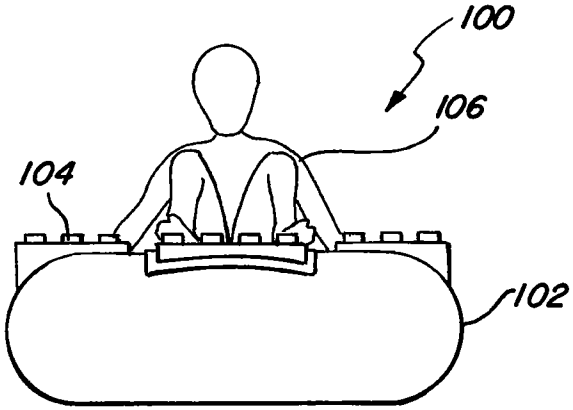
Figure 11:
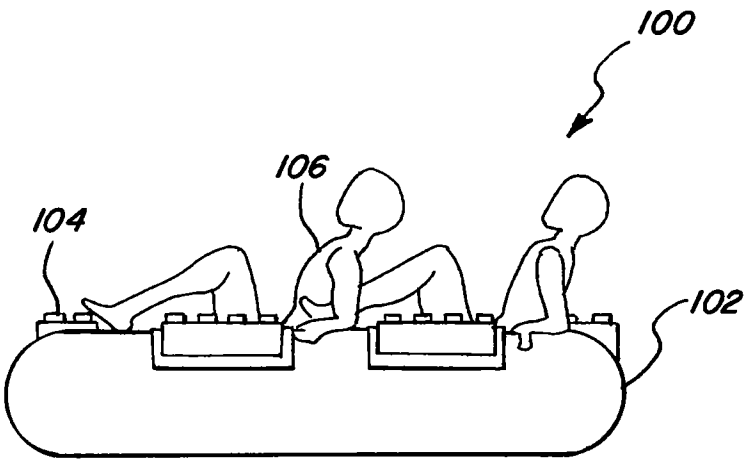
Figure 9:
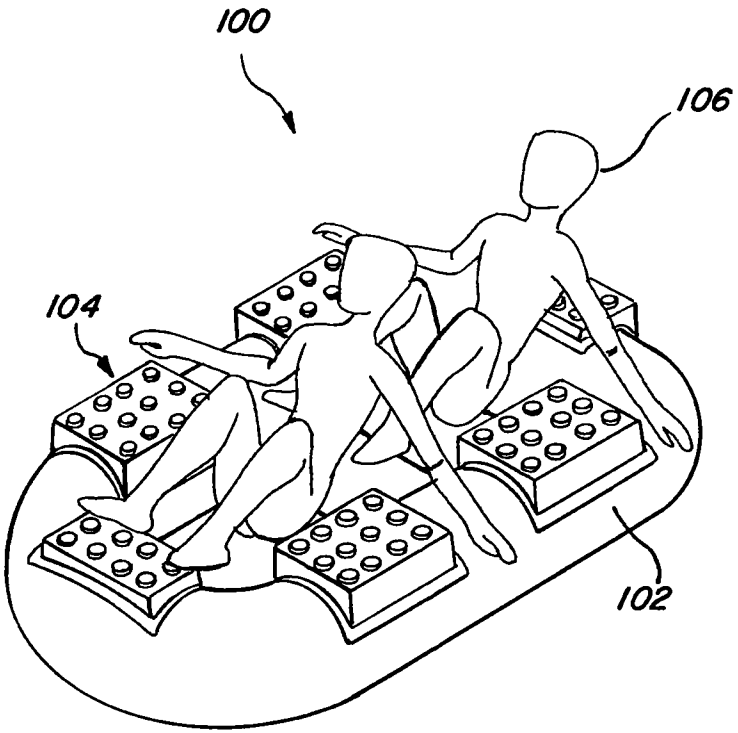
Figure 13:
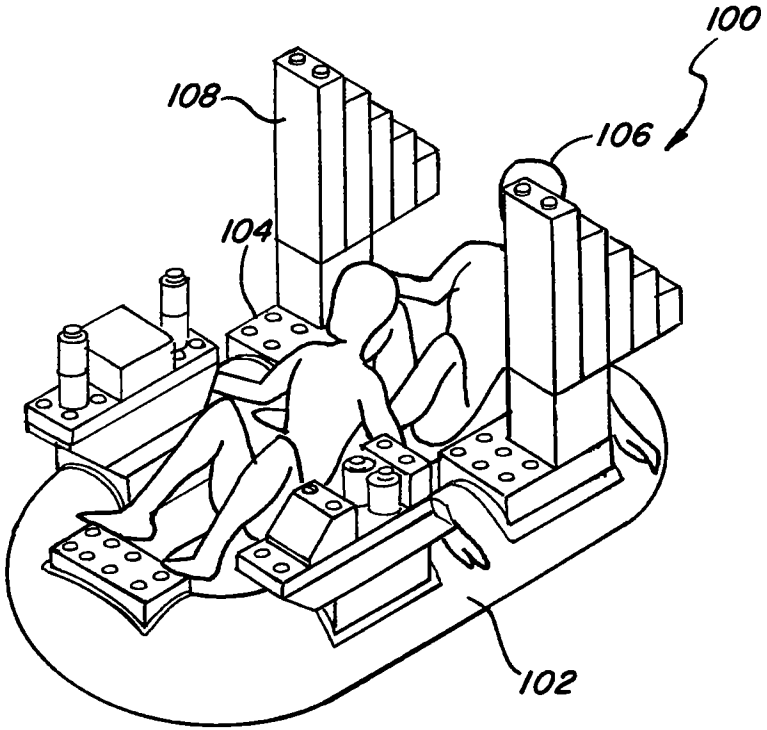
Figure 12:
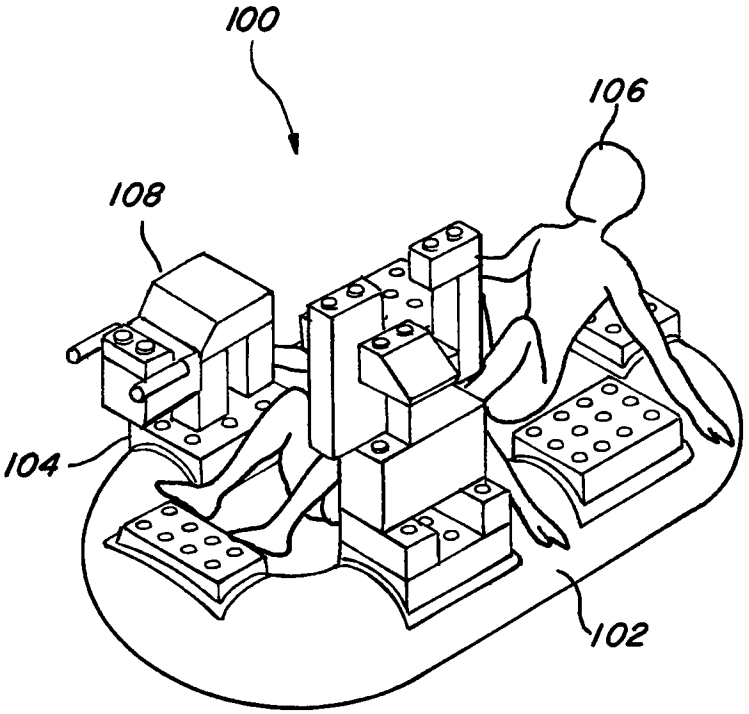
Figure 15:
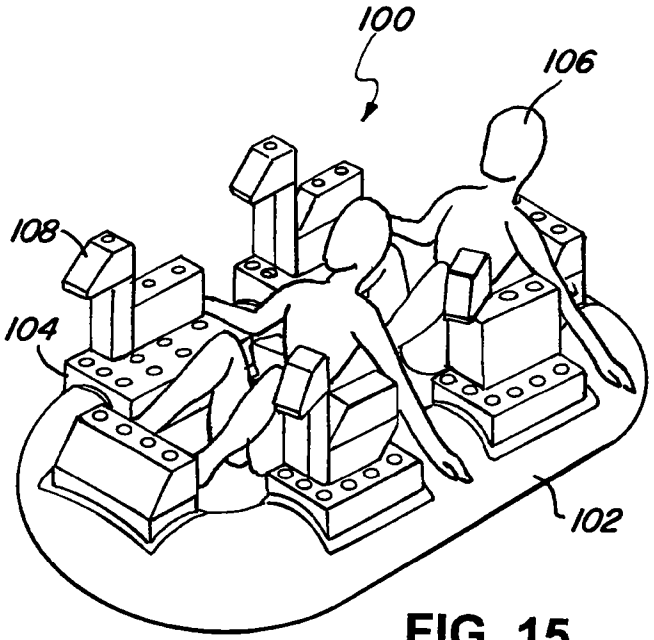
Figure 14:
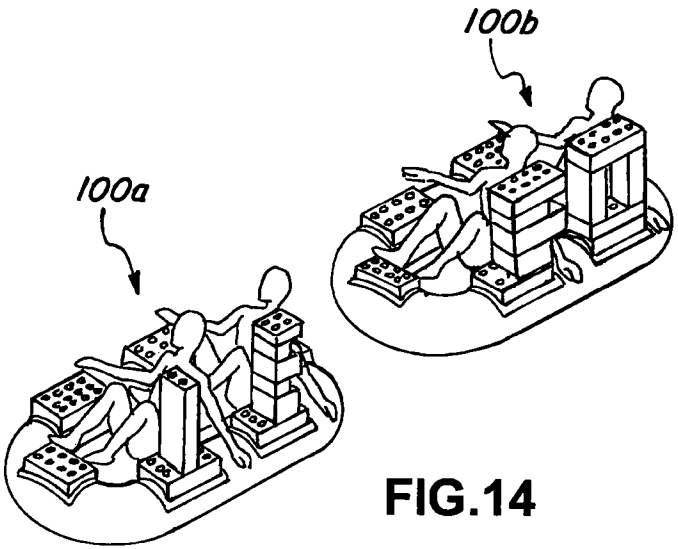
Figure 17:
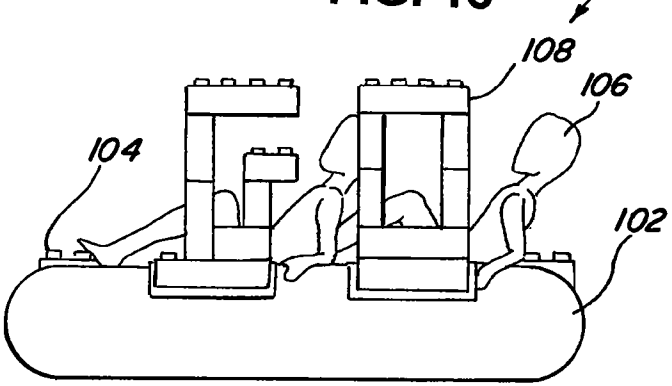
Figure 16:
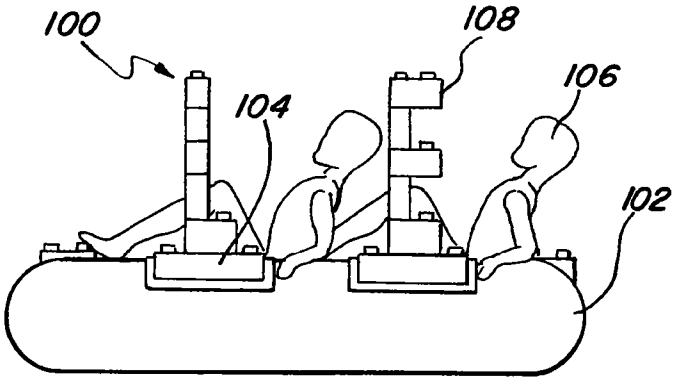
Figure 20:
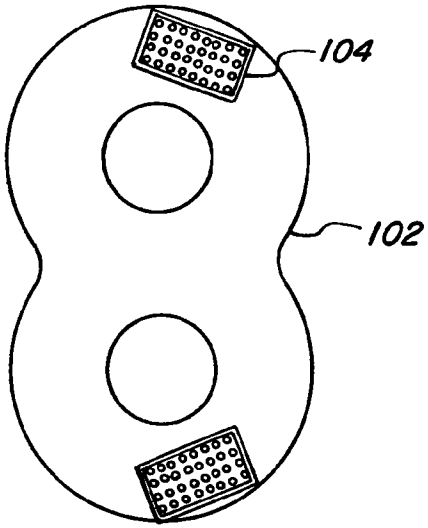
FIGS. 18 to 20 depict various positions of a base unit on a raft according to an embodiment of the present invention.
Figure 19:
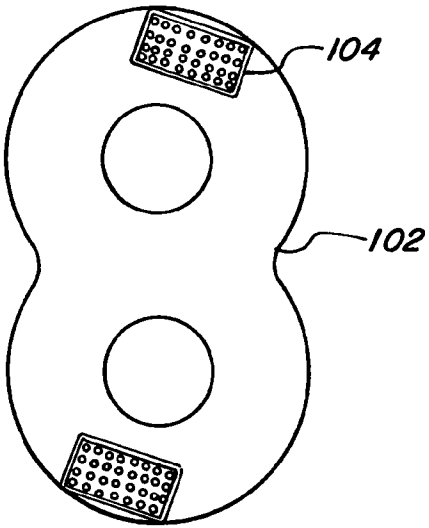
Figure 18:
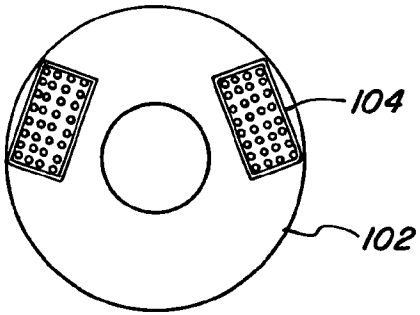
Figure 21:
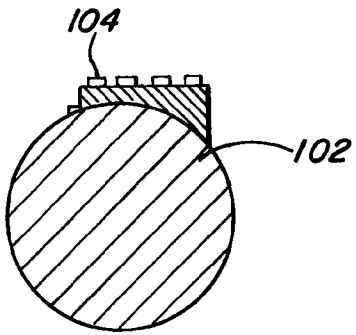
FIG. 21 depicts a cross-section of a portion of a raft with a base unit attached to the according to an embodiment of the present invention.
Figure 22:
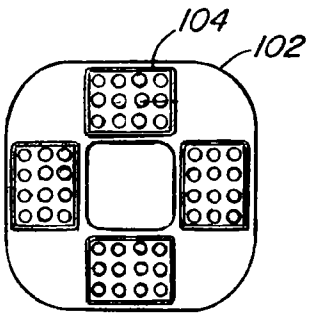
FIGS. 22 to 31 depict various positions of a base unit on a raft according to an embodiment of the present invention.
Figure 23:
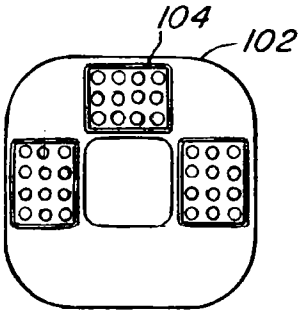
Figure 24:
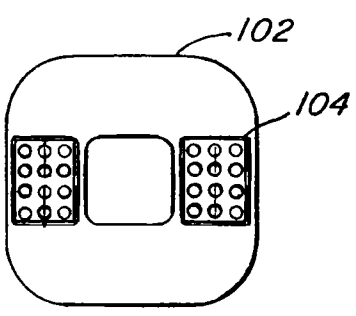
Figure 25:
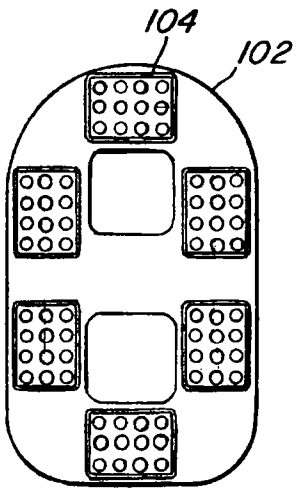
Figure 26:
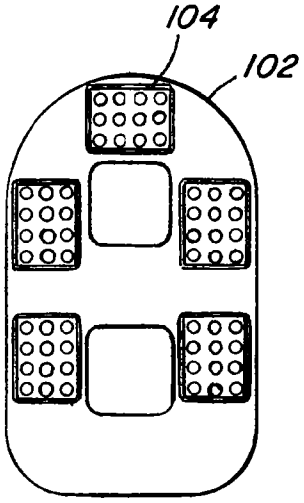
Figure 27:
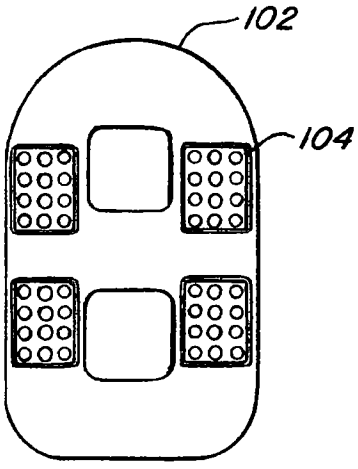
Figure 28:
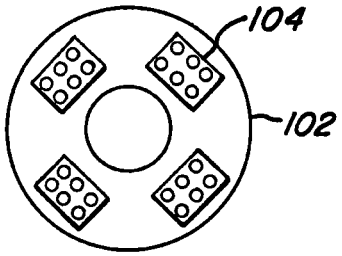
Figure 29:
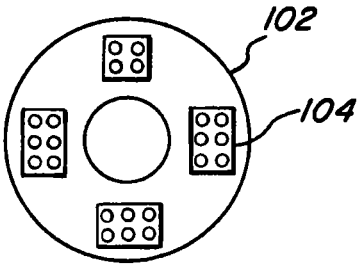
Figure 30:
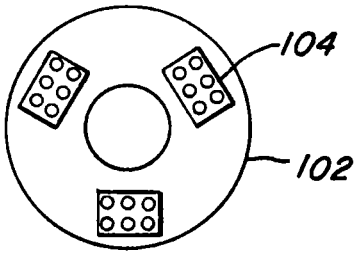
Figure 31:
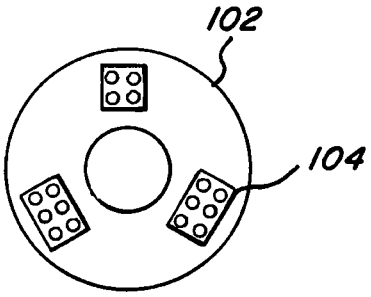
Figure 32:
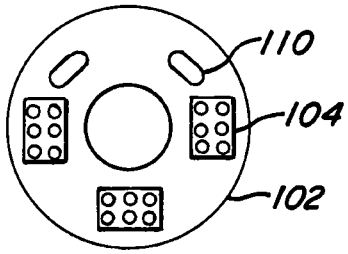
FIGS. 32 to 35 depict various positions of a base unit and handles on a raft according to an embodiment of the present invention.
Figure 33:
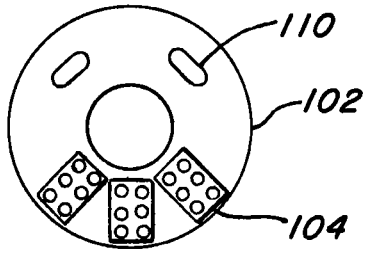
Figure 34:
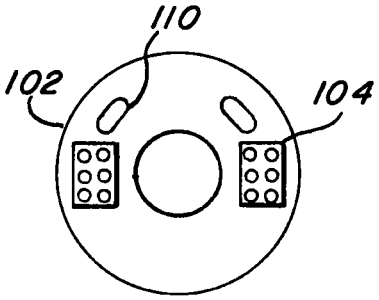
Figure 35:
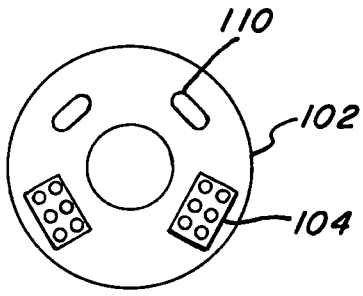
Figure 36:
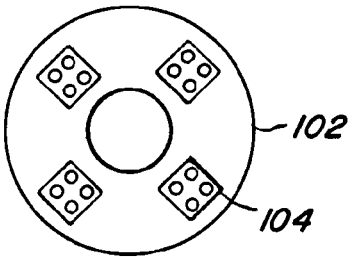
FIGS. 36 to 39 depict various positions of a base unit on a raft according to an embodiment of the present invention.
Figure 37:
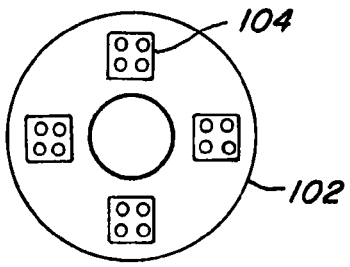
Figure 38:
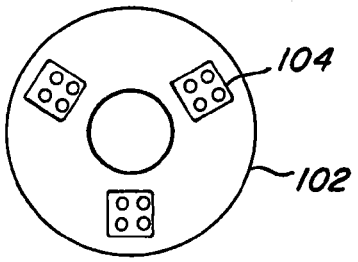
Figure 39:
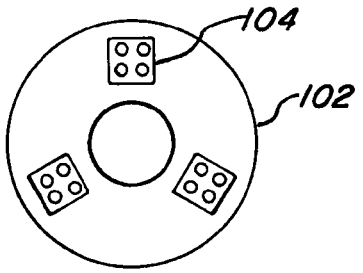
Figure 40:
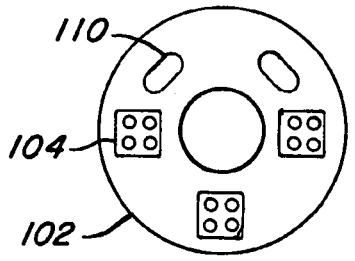
FIGS. 40 to 43 depict various positions of a base unit and handles on a raft according to an embodiment of the present invention.
Figure 41:
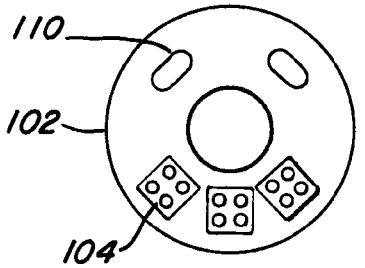
Figure 42:
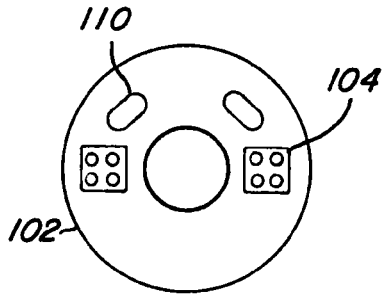
Figure 43:
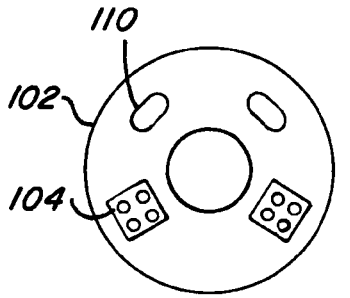
Figure 44:
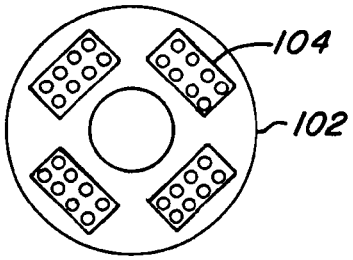
FIGS. 44 to 47 depict various positions of a base unit on a raft according to an embodiment of the present invention.
Figure 45:
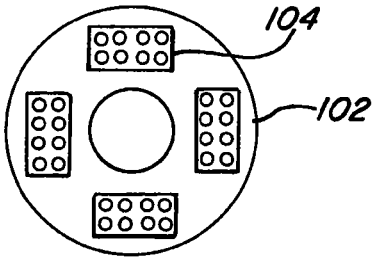
Figure 46:
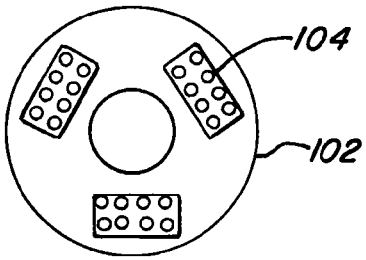
Figure 47:
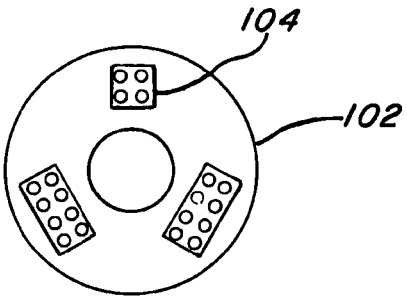
Figure 48:
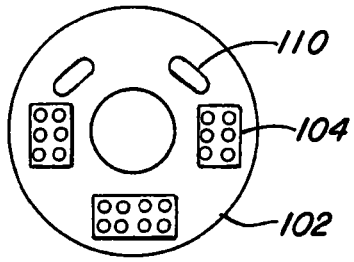
FIG. 48 depicts a positioning of a base unit and handles on a raft according to an embodiment of the present invention.
Figure 49:
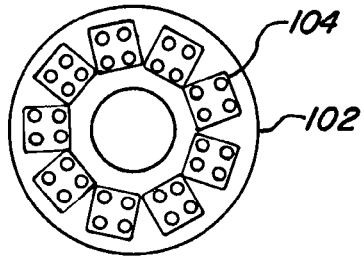
FIG. 49 depicts a positioning of a base unit on a raft according to an embodiment of the present invention.

As seen in FIGS. 18-20, the base unit 104 can be positioned in various locations in the raft 102. In one embodiment, FIGS. 18-20 depict, for example, preferred layouts of the base units 104 on the raft 102. FIG. 21 depicts a cross-section of a portion of the raft 102 with the base unit 104 attached to the raft 102. FIGS. 22 to 31 also depict various locations that the base unit 104 can be positioned in the raft 102. FIGS. 31-35 depict the raft 102 with one or more handles 110. The handles 110 can be used, for example, to provide better grips for the rider 106. In one embodiment, the handles 110 can allow the rider 106 to better grip the raft 102 and allow the rider 106 to easily stay on the raft 102. FIGS. 31-35 also depict additional locations of the base unit 104. In FIGS. 31-35, 2 handles 110 are depicted, but less or more handles can be used as necessary to provide adequate grips for one or more riders 106.

Furthermore, the handles 110 can be molded to conform to a shape of a hand, have ridges, or provide other features to enable a better grip of the handles 110. In one embodiment, the handles 110 can be, for example, a rope or line which can partially or completely surround the raft 102.

FIGS. 36-43 depict additional locations of the base units 104. FIGS. 40-43 depict the rafts 102 with the handles 110. In FIGS. 36-43, the base units 104 are smaller than the base units 104 in FIGS. 28-35. However, the base units 104 can be in various sizes and shapes. FIGS. 44-49, depict additional locations for the base unit 104. As can be seen, in FIG. 48, the raft 102 includes the handles 110. Furthermore, in FIGS. 47 and 48, the rafts 102 include a combination of base units 104 with different sizes.

Therefore, as shown in FIGS. 22-49, the base units 104 can be attached in various locations. In addition, the base units 104 can have various size and shapes. Furthermore, the rafts 102 can also include one or more handles 110.

Figure 50:
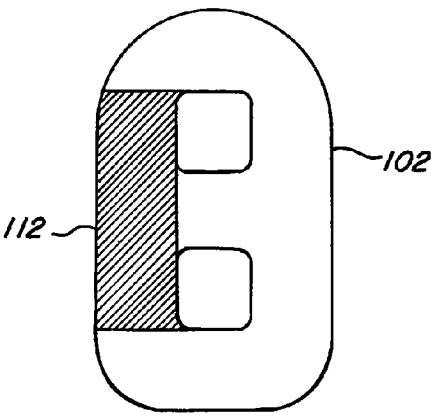
FIGS. 50 to 52 depicts various positions of a base unit on a raft according to an embodiment of the present invention.
Figure 51:
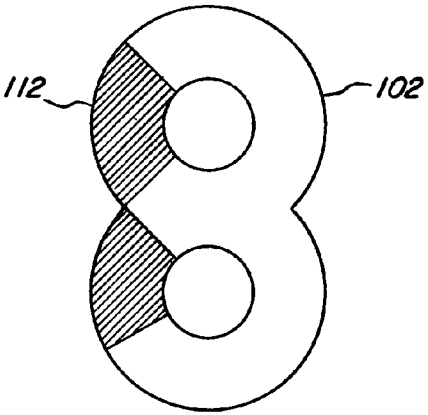
Figure 52:
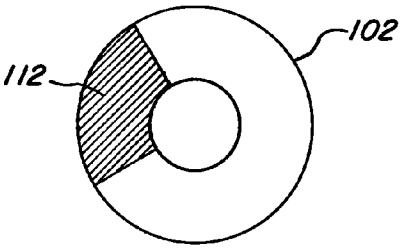
Figure 53:
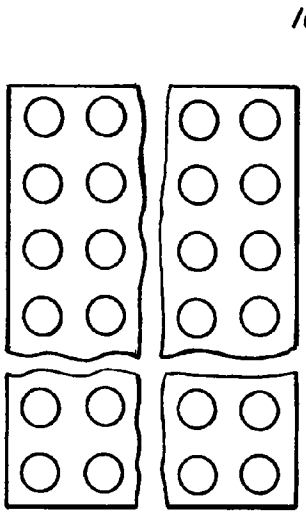
FIG. 53 depicts a base unit according to an embodiment of the present invention.
Figure 54:
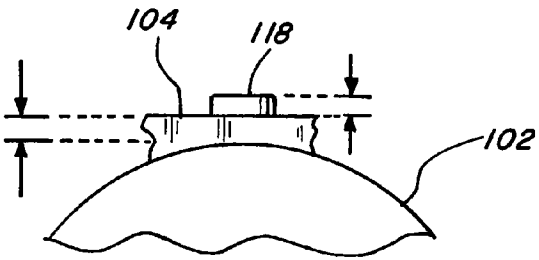
Figure 57:
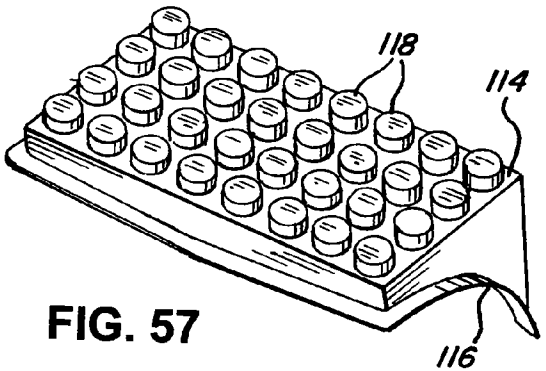
FIGS. 56 to 73 depicts a base unit according to an embodiment of the present invention.
Figure 60:
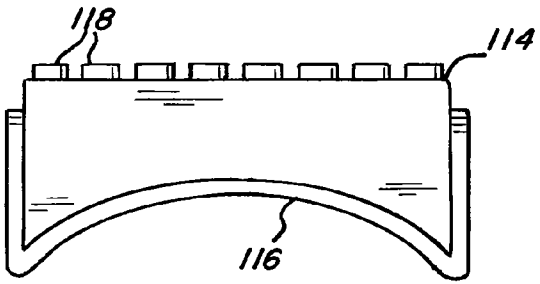
Figure 59:
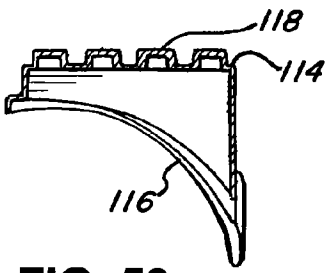
Figure 56:
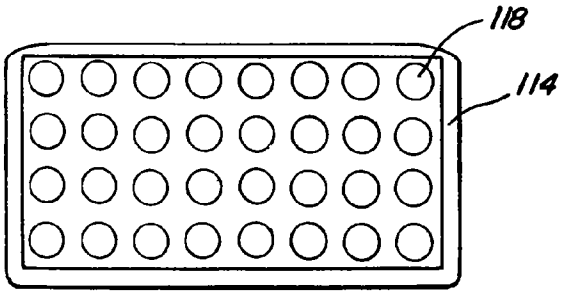
Figure 58:
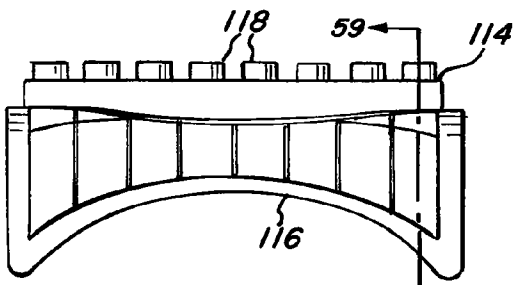
Figure 61:
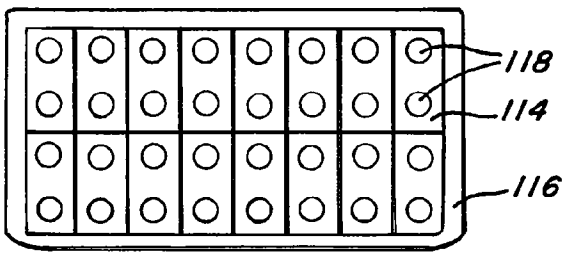
Figure 62:
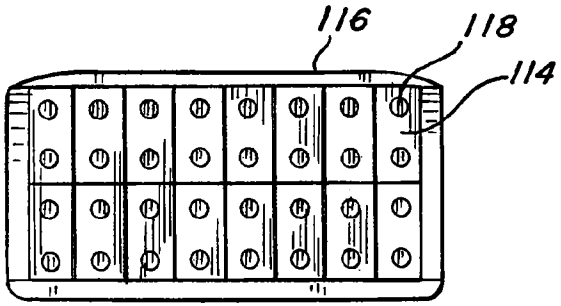
Figure 63:
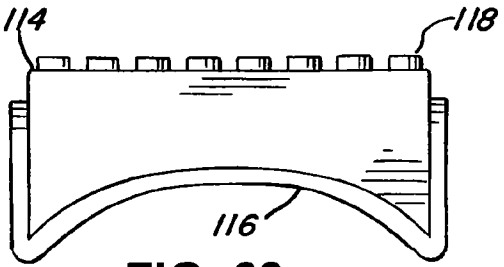
Figure 64:
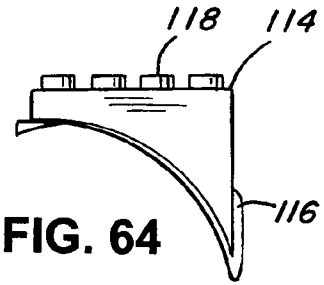
Figure 65:
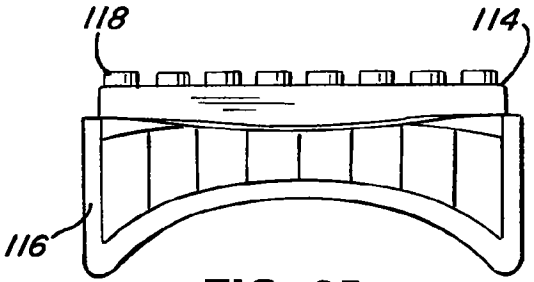
Figure 66:
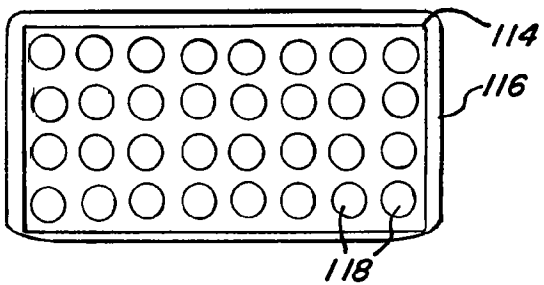

Various locations 112 for attachment of the base unit 104 are also seen in FIGS. 50-52. FIG. 53 depicts a sample base unit 104. FIG. 54 depicts a side view of the base unit 104. FIG. 55 depicts, for example, embodiments of the base unit 104 with various dimensions. In FIG. 55, the base units 104 can have widths of 14.9 inches or 18.625 inches. Furthermore, the base units 104 can have lengths of 14.9 inches, 22.35 inches, 29.8 inches, 18.6250 inches, 22.35 inches, and/or 19.8 inches. The dimensions shown in FIG. 55, however, are merely exemplary and other dimensions may be used.

Figure 67:
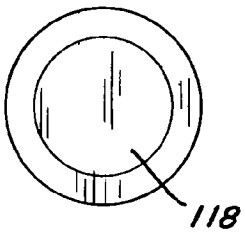
Figure 69:
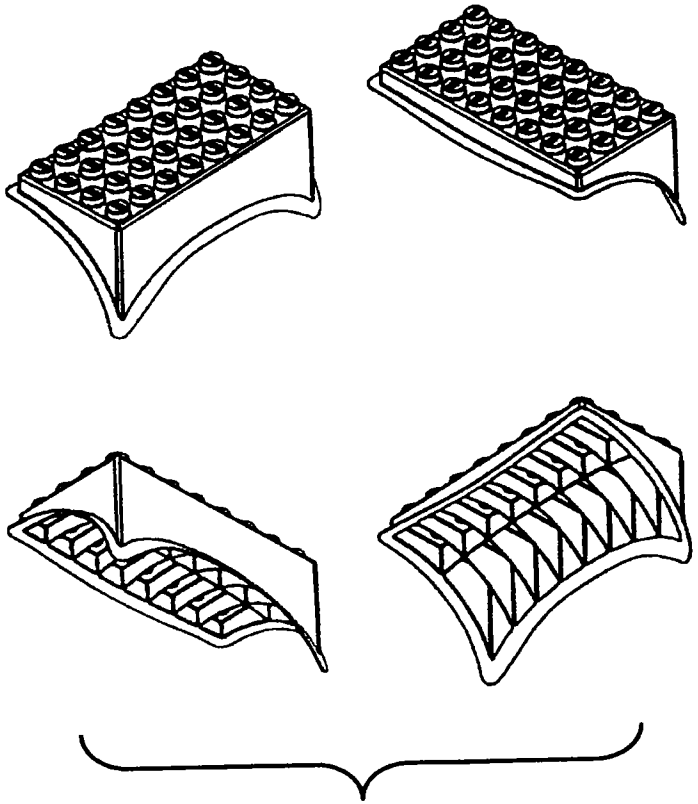
Figure 68:
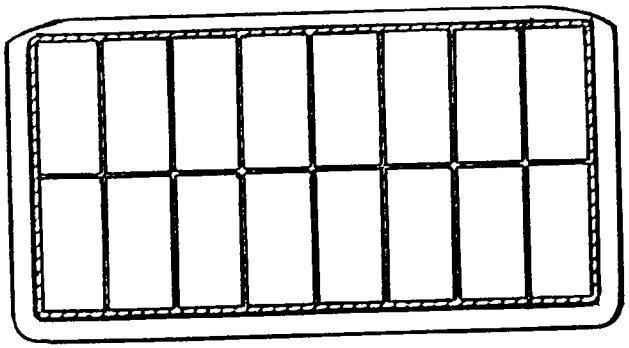
Figure 71:
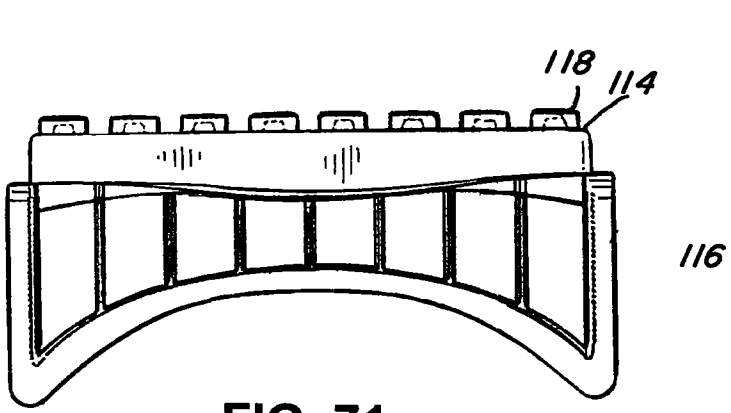
Figure 73:
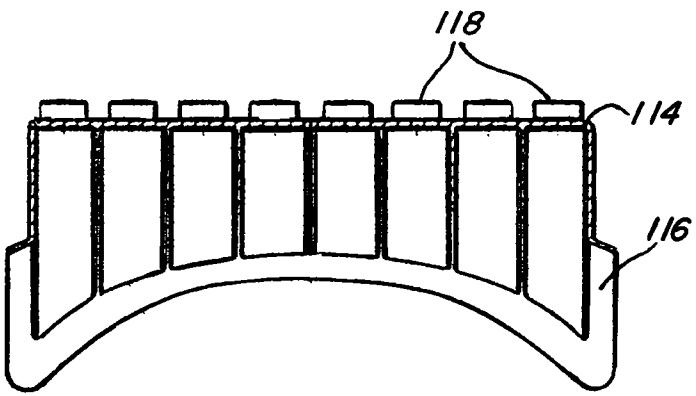
Figure 70:
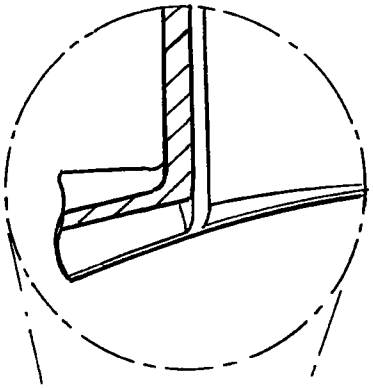
Figure 72:
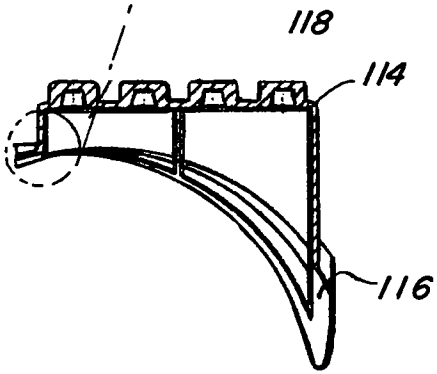

FIGS. 56-73 depict, for example, the base unit 104. The base unit 104 can include, for example, an upper portion 114 and a lower portion 116. The upper portion 114 can include, for example, attachment units 118. The attachment units 118 can be used, for example, to attach the base unit 104 to the building blocks 108. In one embodiment, the attachment units 118 are raised bumps on the base unit 104. In another embodiment, the attachment units 118 are substantially circular. The upper portion 114 is substantially flat, while the lower portion 116 is substantially curved. The lower portion 116 can be substantially curved such that its contour matches the curvature of the raft 102 to allow for easy mating of the base unit 104 to the raft 102. Furthermore, as seen in FIG. 67, a logo such as the Lego® logo can be imprinted on top of the attachment units 118. Although the Lego® logo is shown, any other type of logos may be imprinted on the attachment units 118. In addition instead of logos, images, words, or other indicia can be imprinted on the attachment units 118.

Figure 74:
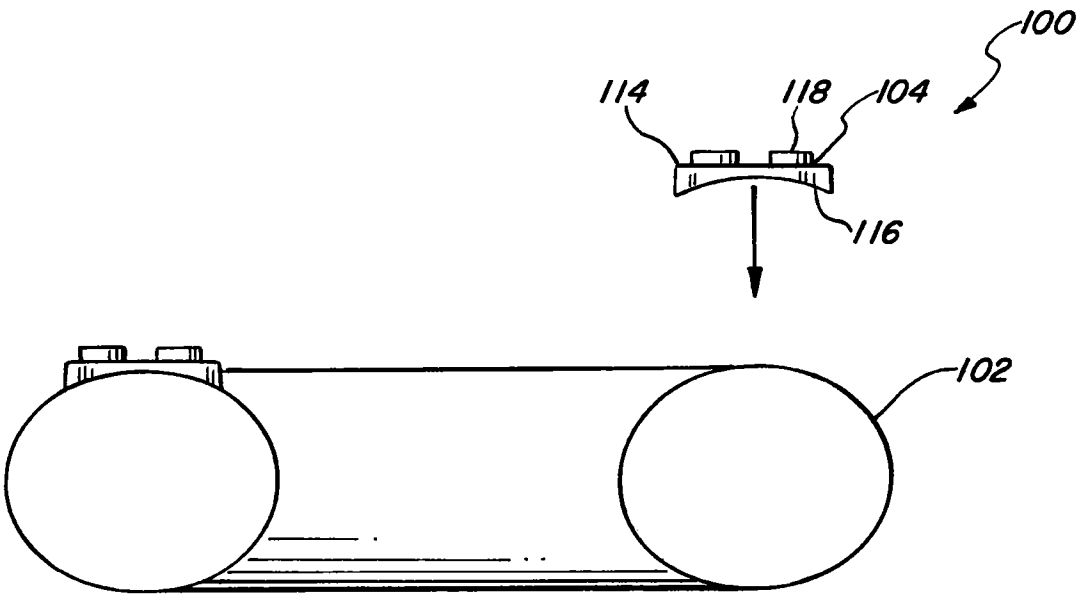
FIG. 74 depicts a side view of a raft and a base unit according to an embodiment of the present invention.

FIG. 74 is a side view of the raft 102 and the base unit 104. As can be seen, the lower portion 116 of the base unit is substantially curved such that it has a radius which matches the curvature of the raft 102. This allows for an easy mating of the base unit 104 with the raft 102.

Figure 75A:
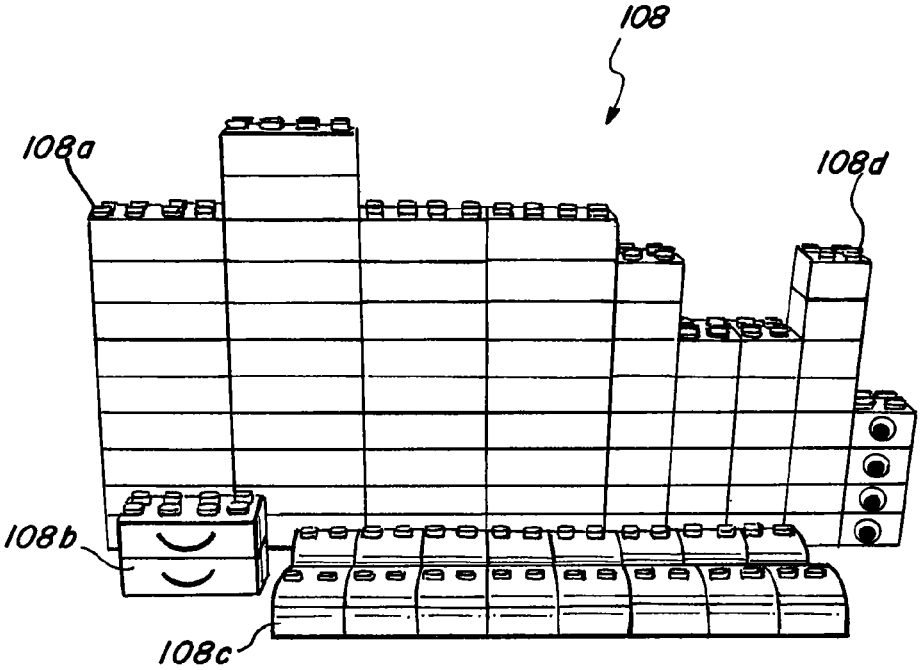
FIGS. 75A and 75B depict various building blocks according to an embodiment of the present invention.
Figure 75B:
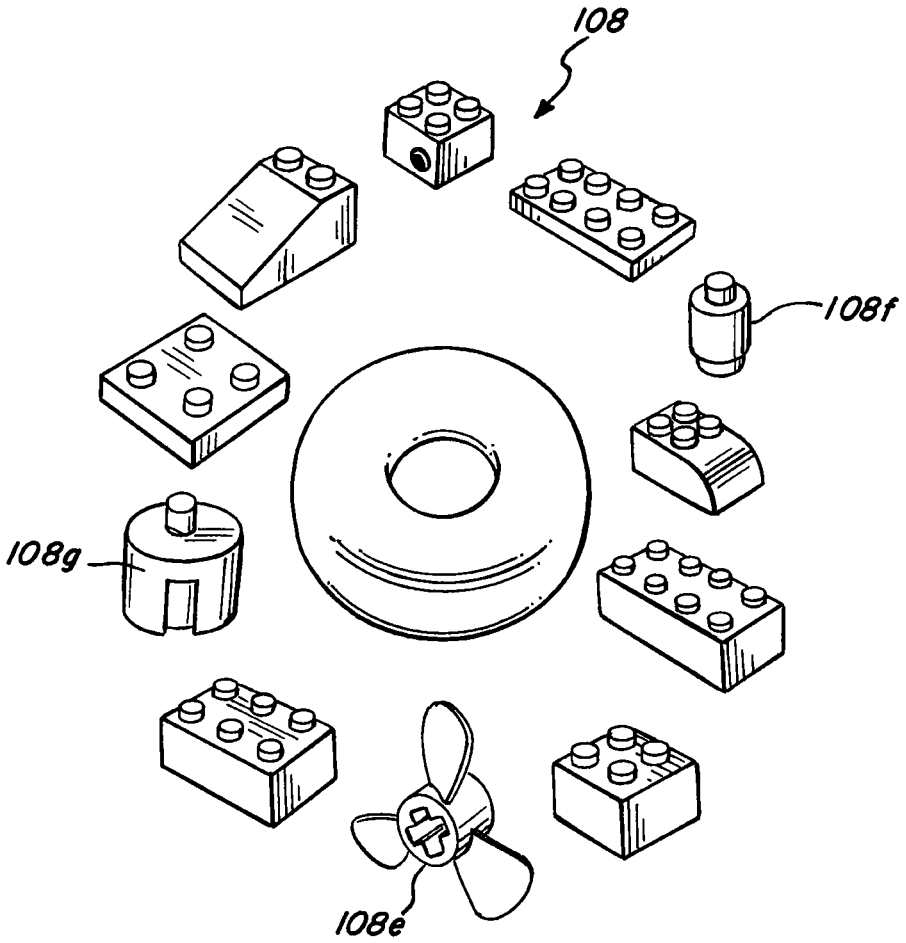

FIG. 75A and FIG. 75B depict, for example, various building blocks 108. As previously noted, the building blocks 108 can come in various shapes, sizes, colors, or indicia. For example, the building block 108*a* is a substantially rectangular brick with a dark color. The building block 108*b* is a substantially rectangular brick with a light color and indicia imprinted on it such as a printed graphic of a smiling mouth. The building block 108*c* is, for example, a curved roof tile. The building block 108*d* is, for example, a square brick. Other information regarding the building blocks 108 depicted in FIG. 75A can be seen in the chart below:

| Array Size | Geometry | Colors | Printed Graphic |
|---|---|---|---|
| 2 × 2 | Brick | Red, Green, Blue, Yellow | None |
| 2 × 2 | Brick | Yellow | Eye |
| 2 × 2 | Curved Roof Tile | Red | None |
| 2 × 4 | Brick | Red, Green, Blue, Yellow | None |
| 2 × 4 | Brick | Yellow | Mouth |
| 2 × 4 | Curved Roof Tile | Red | None |

However, the chart above is merely illustrative and other sizes, shapes, colors, and indicia may be used for the building blocks 108. In addition, FIG. 75B, the building block 108*e* is a propeller while the building block 108*f* is a circular barrel. The building block 108*g* is a circular structure.

Figure 76A:
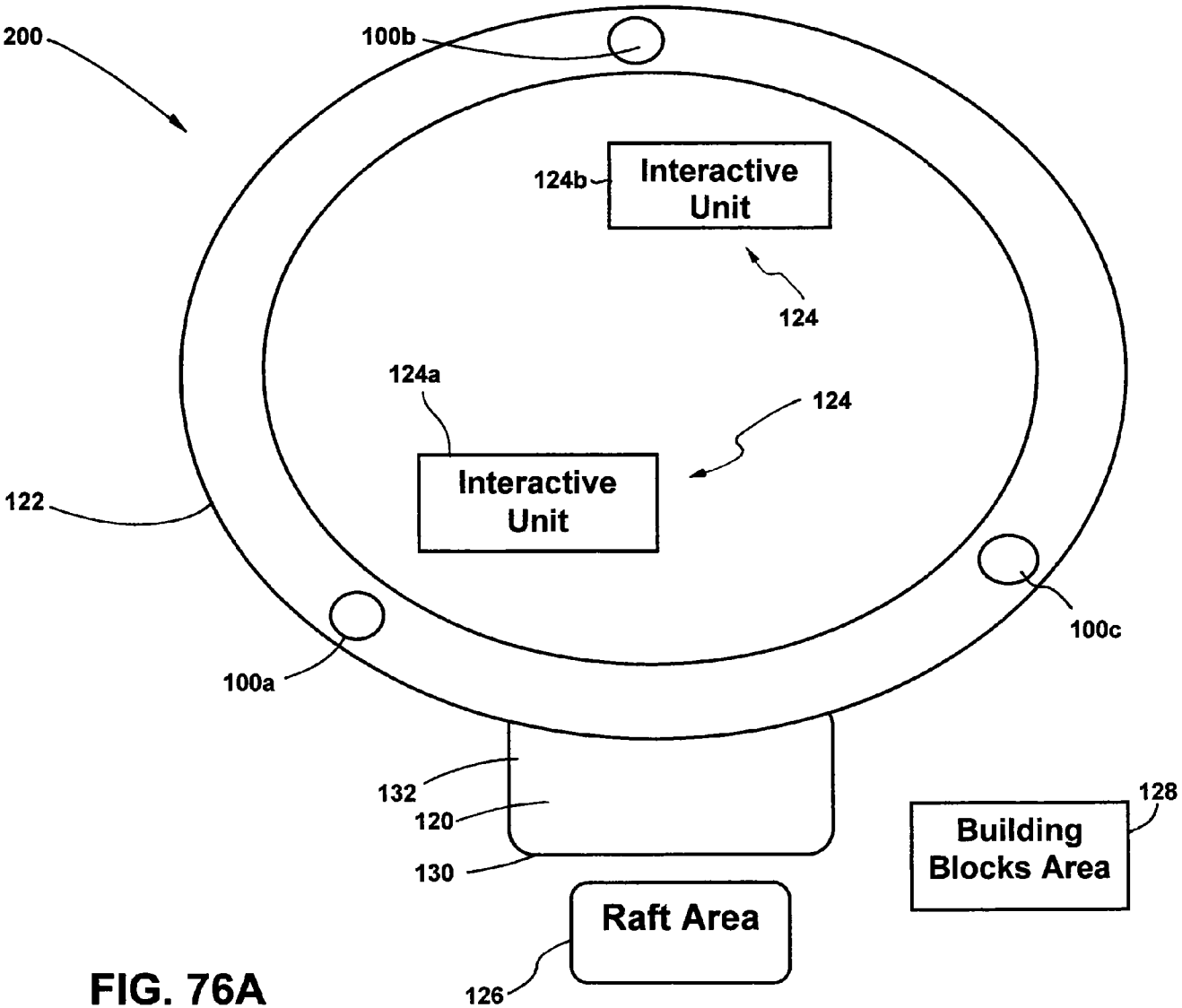
FIGS. 76A, 76B, and 76C depict a water ride including expandable modular raft systems on a path according to an embodiment of the present invention.

FIG. 76A depicts, for example, a water ride 200 which utilizes the expandable modular raft systems 100. The water ride 200 includes, for example, a path 122. The path 122 can be, for example, a river. The modular raft system 100 float along the path 122. In FIG. 76A, the path 122 is substantially circular such that a beginning of the path 122 is connected to an end of the path 122.

An entrance and exit zone 120 is connected to the path 122. Using the entrance and exit zone 120, a rider of the expandable modular raft systems 100 can enter the path 122 or exit the path 122. The entrance and exit zone 120 can include, for example, a shallow end 130 and a deep end 132. The shallow end 130 allows for easy entrance or exit into the entrance and exit zone 120. The depth of the entrance and the exit zone 130 gradually increases from the shallow end 130 to the deep end 132. The deep end 132 has a depth that is substantially equal to the depth of the path 122.

The water ride 200 also includes, for example, a raft area 126 and a building blocks area 128. A plurality of rafts 126 can be located in the raft area 126 and a plurality of building blocks 108 can be located in the building blocks area 128. In addition, the water ride 200 can include a plurality of interactive units 124 such as the interactive units 124*a* and 124*b*. The interactive units 124 can interact with the expandable modular raft systems 100 as it floats along the path 122. The interactive units 124 can be, for example, a unit which sprays water, shoots balls, makes noise, provides graphics, lights up, or provides other interactive measures to interact with the expandable modular raft systems 100.

In operation, a rider picks up a raft 100 in the raft area 126. The rider can also optionally pick up a plurality of building blocks 128 and mount them to the raft 100, such as through the base unit 104. The raft 100 and/or the building blocks 128 form an expandable modular raft system 100. The rider then moves the expandable modular raft system 100 into the entrance and exit zone 120 by wading into the shallow end 130. The rider 130 can wade towards the deep end 132 and eventually gets up onto the raft 102 of the expandable modular raft system 100.

The rider then floats along the path 122. The interactive units 124 can interact with the rider 130 and/or the expandable modular raft system 100 as the rider floats along the path 122. In one embodiment, the rider can also pick up additional building blocks 122 along the path 122. In another embodiment, the rider 130 can also interact with bystanders, targets, the interactive units 124, such as with water guns, shields, balls, or any other interactive device which allows the user to interact with the bystanders and/or the interactive units 124. The rider 130 can pick up such interactive devices along with the raft 102 or while floating along the path 122. In one embodiment, the rider can rent the interactive devices.

In another embodiment, the rider can also earn points or other score keeping measure based on a level of interaction with the interactive units 124. Upon traversing the path 122, the rider can exit the expandable modular raft system 100 at or near the entrance and exit zone 120 and move the expandable modular raft system 100 from the deep end 132 to the shallow end 130. The rider can then disassemble the expandable modular raft system 100 by separating the building blocks 108 from the raft 102, or leave the expandable modular raft system 100 for subsequent disassembly or subsequent use by another rider or staff member of the water ride 200. Although the water ride 200 is substantially circular in FIG. 76A, the water ride 200 can have a variety of shapes that can be curved in various locations including various turns.

Figure 76B:
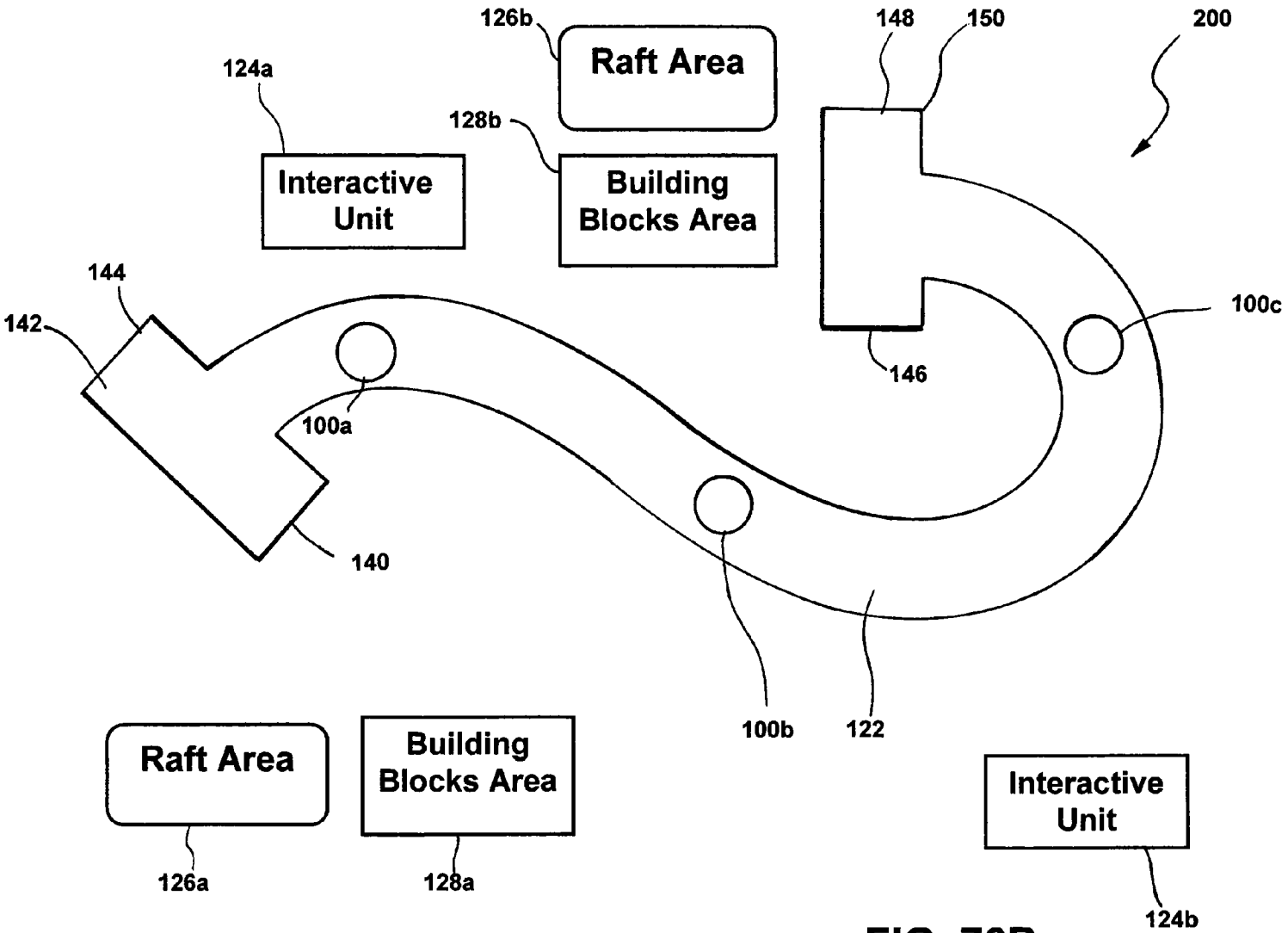

FIG. 76B depicts an alternate embodiment of the water ride 200. In FIG. 76B, the beginning of the path 122 is not connected to the end of the path 122. Thus, instead of an entrance and exit zone 120, the ride 200 in FIG. 76B utilizes an entrance zone 140 and an exit zone 146. The entrance zone 140 includes a shallow end 142 and a deep end 144. The exit zone 146 includes a shallow end 148 and a deep end 150. Furthermore, instead of a single raft area 126, and a single building blocks area 128, the water ride 200 includes a raft area 126*a*, a raft area 126*b*, a building blocks area 128*a*, and a building blocks area 128*b*.

The raft area 126*a* and the building blocks area 128*a* can be positioned near the entrance zone 140 so that riders can use the rafts in the raft area 126*b* and the building blocks in the building blocks 128 to construct an expandable modular raft system 100. The raft area 126*b* and the building blocks area 128*b* can be positioned near the exit zone 140 so the expandable modular raft system 100 of the riders who have completed the path 122 can be deconstructed. In one embodiment, the rafts and the building blocks in the raft area 126*b* and the building blocks area 128*b* can be transported to the raft area 126*a* and the building blocks area 128*b*. This can reduce, for example, an amount of rafts and building blocks required in the water ride 200.

In operation, a rider retrieves a raft from the raft area 126*a* and building blocks from the building blocks area 128 to form the expandable modular raft system 100. Once the expandable modular raft system 100 is formed, the rider enters the path 122 by wading through the entrance zone 140 and progressively traverses the shallow end 142 to the deep end 144. The rider then floats through the path 122 in the expandable modular raft system 100, such as the expandable modular raft systems 100*a*, 100*b*, and/or 100*c*, where the interactive units 124*a* and/or the 124*b* can interact with the expandable modular raft system 100. Again, the rider can also interact with the interactive units 124*a* and 124*b*, targets, and/or bystanders using interactive devices such as water guns, shields, and/or balls.

At the completion of the path 122, the rider can exit through the exit zone 122 and progressively traverse the deep end 150 and the shallow end 148. The expandable modular raft system 100 can be deconstructed into the raft and the building blocks for placement in the raft area 126*b* and/or the building blocks area 128*b*.

In one embodiment, the in addition to the riders, waders can wade through the path 122 in the water ride 200. The waders can wade through the path 122 with or without an expandable modular raft system 100.

Figure 76C:
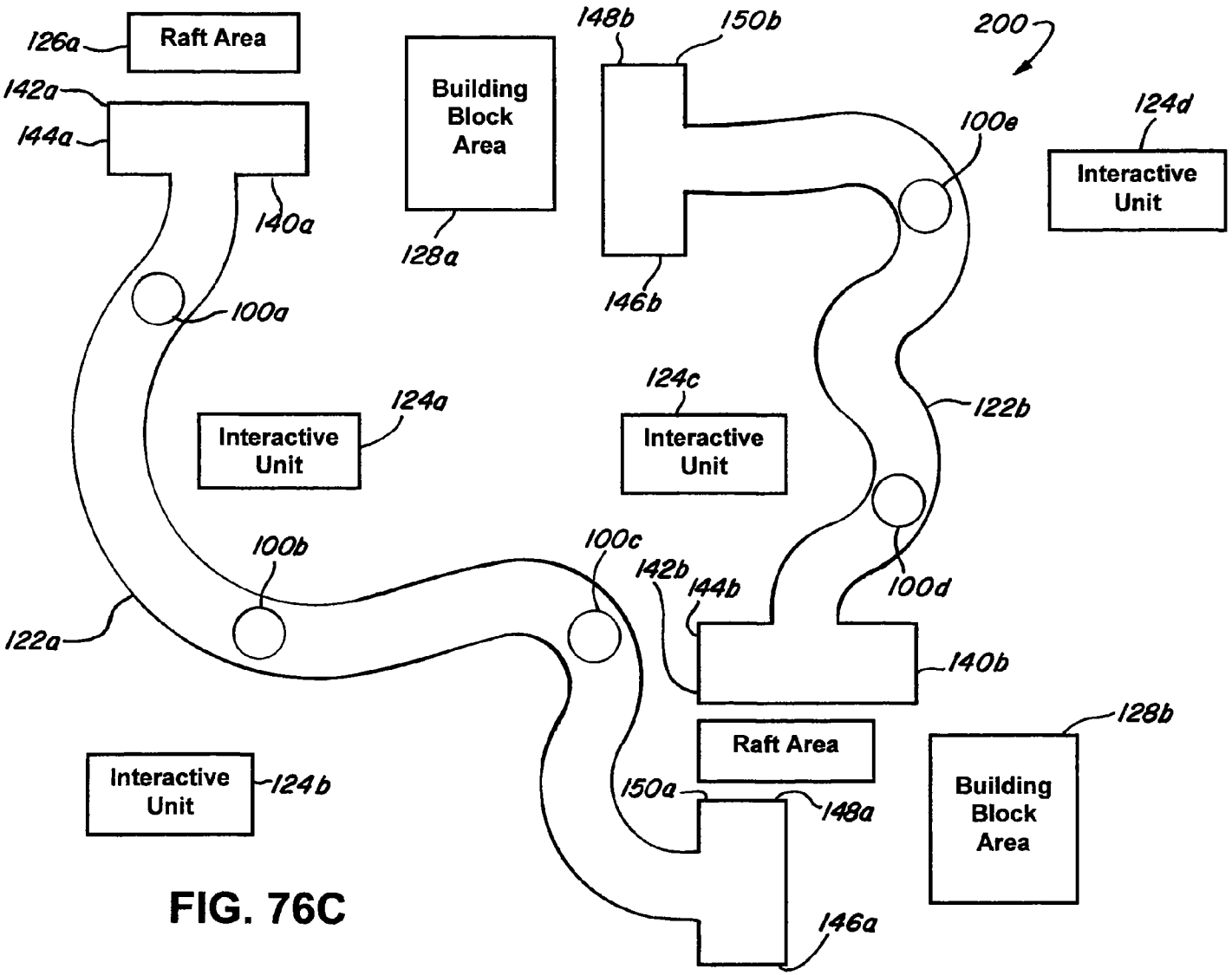

FIG. 76C depicts another embodiment of the water ride 200. In FIG. 76C instead of a single path 122, multiple paths such as paths 122*a* and 122*b* are used. The paths 122*a* and 122*b* can be located adjacent to each other. The path 122*a* includes an entrance zone 140*a* with a shallow end 142*a* and a deep end 144*a*, and an exit zone 146*a* with a shallow end 148*a* and a deep end 150*a*, while the path 122*b* includes an entrance zone 140*b* with a shallow end 142*b* and a deep end 144*b*, and an exit zone 146*b* with a shallow end 148*b* and a deep end 150*b*. The interactive units 124*a* and 124*b* can be placed near the path 122*a*, and the interactive units 124*c* and 124*d* can be placed near the path 122*b*. The expandable modular raft system 100*a*, 100*b*, and 100*c* can float through the path 122*a* while the expandable modular raft system 100*d* and 100*e* can float through the path 122*b*.

The raft area 126*a* and the building block area 128*a* are placed near the entrance zone 140*a* of the path 122*a* and the exit zone 146*b* of the path 122*b*. Similarly, the raft area 126*b* and the building block area 128*b* are placed near the exit zone 146*a* of the path 122*a* and the entrance zone 140*b* of the path 122*b*. In operation, this allows the riders of the path 122*a* to build the expandable modular raft system 100 using materials in the raft area 126 and the building block area 128*a*. After the riders of the path 122*a* have traversed the path 122*a*, they can deconstruct the expandable modular raft system and place the materials in the raft area 126*b* and the building block area 128*b*.

The riders of the path 122*b* can then use the same materials in the raft area 126*b* and the building block area 128*b* to build the expandable modular raft system 100. After the riders of the path 122*b* have traversed the path 122*b*, the riders can deconstruct the expandable modular raft system 100 and place the materials in the raft area 126*a* and the building block area where the riders for path 122*a* can use them.

In this manner, the materials for the expandable modular raft system 100 do not need to be moved large distances by the employees, but instead are ready for the riders of the other path. However, in one embodiment, the riders of the paths 122*a* and 122*b* do not need to deconstruct their expandable modular raft system after they've traversed the paths 122*a* and 122*b*, respectively, but instead could traverse the paths 122*b* and 122*a*, respectively.

In one embodiment, the expandable modular raft system 100 is not limited to just the water ride 200, but can also be used, for example, in various bodies of water such as a lake, a natural river, a family swimming pool, a public swimming pool, or other areas where there is water. In addition, the expandable modular raft system 100 need not interact with water, but instead could be a stand alone play element.

Furthermore, although in the above example, the expandable modular raft system 100 floats along a path, the expandable modular raft system 100 could also be used in conjunction with a water slide in one embodiment. The water slide can, for example, feed into the path and can be part of the water ride containing the path.

In addition, in the case where the building blocks 108 do not float in water, the building blocks can be collected throughout the day using a retrieval system. Furthermore, the water ride could have, for example, shallow portions throughout the path to allow operators to retrieve the building blocks 108 which do not float in water. The shallow portions could permit, for example, the operators to access deeper portions of the path.

Figure 79:
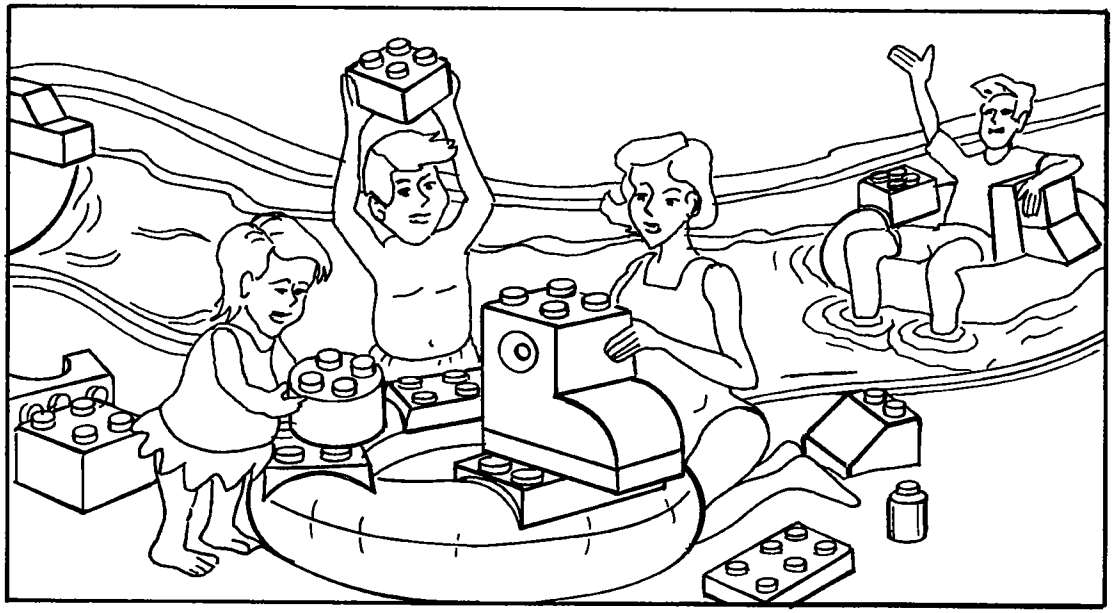
FIG. 79 is a sketch of an expandable modular raft system according to an embodiment of the present invention.

FIGS. 77 and 78 each depict, for example, a base unit 104 on a raft 102 according to an embodiment of the present invention. FIG. 79 depicts, for example, a sketch of an expandable modular raft system embodiment of the present invention.

The expandable modular raft system 100 allows, for example, the riders to customize the expandable modular raft system 100 as they see fit. This can promote, for example, a creative atmosphere and greater rider enjoyment. Furthermore, with many combinations possible for customization, riders may be enticed to experience the water ride including the expandable modular raft system 100 repeatedly.

The previous description of the disclosed examples is provided to enable any person of ordinary skill in the art to make or use the disclosed methods and apparatus. Various modifications to these examples will be readily apparent to those skilled in the art, and the principles defined herein may be applied to other examples without departing from the spirit or scope of the disclosed method and apparatus. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope. Skilled artisans may implement the described functionality in varying ways for each particular application, but such implementation decisions should not be interpreted as causing a departure from the scope of the disclosed apparatus and methods. The steps of the method or algorithm may also be performed in an alternate order from those provided in the examples.

What is claimed is:

1. An expandable modular raft system comprising:

a raft wherein at least a part of the raft has a contour; and a base unit formed separately from the raft, the base unit having an upper portion with a first surface and configured to attach with a building block having different dimensions than the base unit and the raft, the base unit having a lower portion with a second surface matching the contour of the raft for mating the base unit to the raft.

2. The system of claim 1 further comprising a plurality of building blocks configured to be connected to the base unit and to each other.

3. The system of claim 2 wherein at least one of the plurality of building blocks is configured to be force fit to the base unit and to each other.

4. The system of claim 2 wherein at least one of the plurality of building blocks is formed from ethylene vinyl acetate foam.

5. The system of claim 2 wherein at least one of the plurality of building blocks is configured to float in water.

6. The system of claim 2 wherein at least one of the plurality of building blocks is configured to compress under a compressive load, and retain its shape upon removal of the compressive load.

7. The system of claim 2 wherein at least one of the plurality of building blocks is formed from an ultraviolet radiation resistant material.

8. The system of claim 1 wherein the raft includes an inner tube.

9. The system of claim 1 wherein the base unit is attached to the raft using mechanical locks or fasteners.

10. The system of claim 1 wherein the base unit is welded or glued to the raft.

11. The system of claim 1 wherein the raft includes a plurality of handles.

12. The system of claim 1 wherein the first surface of the upper portion has at least one raised bump protruding therefrom, the raised bump configured to be received by the building block if the base unit is attached to the building block.

13. An expandable modular raft system comprising:

an inflatable raft having a contoured portion;

a base unit having an upper portion and a lower portion, the upper portion having a first surface, the lower portion having a second surface with a contour matching the contoured portion of the raft, the base unit connected to the raft via the second surface;

an attachment unit protruding from the surface of the upper portion; and a building block configured to connect to the base unit via the attachment unit, wherein the building block has different dimensions than the base unit and the raft.

14. The system of claim 13 wherein the building block is configured to be force fit to the base unit and to a second building block.

15. The system of claim 13 wherein the building block is formed from ethylene vinyl acetate foam.

16. The system of claim 13 wherein the building block is formed from an ultraviolet radiation resistant material.

17. The system of claim 13 wherein the base unit is connected to the raft using mechanical locks or fasteners.

18. The system of claim 13 wherein the base unit is welded or glued to the raft.

19. The system of claim 13 wherein the raft includes an inner tube and a plurality of handles.

20. A water ride comprising:

a water path;

a raft area adjacent the path storing a raft, the raft having a contoured portion that mates with a corresponding contoured portion of a base unit that is formed separately from the raft; and a building block area adjacent the path storing a building block having a different dimension than both the raft and the base unit, wherein the raft and the building block are configured to be combined via the base unit to form an expandable modular raft system which can traverse the water path.

21. The water ride of claim 20 further comprising an interactive unit located adjacent the path.

22. The water ride of claim 20 further comprising an entrance and exit zone located adjacent the path.

23. The water ride of claim 22 wherein the raft area and the building block area are located adjacent the entrance and exit zone.

24. The water ride of claim 20 wherein the path includes a first end and a second end opposite the first end.

25. The water ride of claim 24 further comprising an entrance zone located adjacent the first end of the path, and an exit zone located adjacent the second end of the path.

26. The water ride of claim 25 wherein the raft area and the building block area are located adjacent the entrance zone.

* * * * *